US008952881B2

(12) United States Patent
Nonaka et al.

(10) Patent No.: US 8,952,881 B2
(45) Date of Patent: Feb. 10, 2015

(54) IMAGE DISPLAY APPARATUS AND INFORMATION PROCESSING APPARATUS

(75) Inventors: Ryosuke Nonaka, Yokohama (JP); Masahiro Baba, Yokohama (JP); Yuma Sano, Kawasaki (JP)

(73) Assignee: Kabushiki Kaisha Toshiba, Minato-ku, Tokyo (JP)

( * ) Notice: Subject to any disclaimer, the term of this patent is extended or adjusted under 35 U.S.C. 154(b) by 522 days.

(21) Appl. No.: 13/071,586

(22) Filed: Mar. 25, 2011

(65) Prior Publication Data

US 2012/0056918 A1 Mar. 8, 2012

(30) Foreign Application Priority Data

Sep. 7, 2010 (JP) ..... 2010-200212

(51) Int. Cl.

*G09G 3/36* (2006.01)
*G09G 3/10* (2006.01)
*G09G 3/34* (2006.01)

(52) U.S. Cl.

CPC ..... *G09G 3/342* (2013.01); *G09G 3/3413* (2013.01); *G09G 3/3426* (2013.01); *G09G 3/3648* (2013.01); *G09G 2320/0276* (2013.01); *G09G 2320/0285* (2013.01);

(Continued)

(58) Field of Classification Search

USPC ..... 345/102, 690
See application file for complete search history.

(56) References Cited

U.S. PATENT DOCUMENTS

| | | | | |
|---|---|---|---|---|
| 7,948,563 | B2 * | 5/2011 | Sono | 348/687 |
| 2005/0184952 | A1 * | 8/2005 | Konno et al. | 345/102 |
| 2007/0070214 | A1 * | 3/2007 | Nakamura | 348/222.1 |

(Continued)

FOREIGN PATENT DOCUMENTS

| | | |
|---|---|---|
| JP | 2007-34251 | 2/2007 |
| JP | 2010-145627 A | 7/2010 |

(Continued)

OTHER PUBLICATIONS

Albrecht, et al., "Sorted Sector Covering Combined with Image Condensation—An Efficient Method for Local Dimming of Direct-Lit and Edge-Lit LCD's", IEICE Trans. Electron, vol. E93-C, No. 11, Nov. 2010, pp. 1556-1563.

(Continued)

*Primary Examiner* — Joe H Cheng
*Assistant Examiner* — Benyam Ketema
(74) *Attorney, Agent, or Firm* — Ohlandt, Greeley, Ruggiero & Perle, L.L.P.

(57) ABSTRACT

According to one embodiment, an image display apparatus includes a liquid crystal panel, a backlight, a luminance distribution calculation unit, an error calculation unit, and an emission intensity update unit. The backlight includes a plurality of light sources which emit light. The luminance distribution calculation unit calculates a predicted value for an intensity distribution of light entering the liquid crystal panel if each of the light sources is lit with an emission intensity. The error calculation unit obtains a brightness of a display image which is realized if the each of the light sources is lit with the emission intensity, and the error calculation unit calculates an error between the obtained brightness and an ideal brightness of the display image corresponding to the input video signal. The emission intensity update unit updates the emission intensity of the each of the light sources to reduce the error.

15 Claims, 16 Drawing Sheets

(52) U.S. Cl.
CPC . *G09G 2320/0646* (2013.01); *G09G 2320/066* (2013.01); *G09G 2330/021* (2013.01); *G09G 2360/16* (2013.01)
USPC ..... 345/102; 345/690

(56) References Cited

U.S. PATENT DOCUMENTS

| | | | | |
|---|---|---|---|---|
| 2007/0182700 | A1* | 8/2007 | Baba et al. | 345/102 |
| 2008/0001881 | A1* | 1/2008 | Baba et al. | 345/89 |
| 2008/0117160 | A1* | 5/2008 | Oka et al. | 345/102 |
| 2009/0115720 | A1* | 5/2009 | Inada et al. | 345/102 |
| 2009/0140975 | A1* | 6/2009 | Nonaka et al. | 345/102 |
| 2010/0020003 | A1* | 1/2010 | Feng | 345/102 |
| 2010/0238201 | A1* | 9/2010 | Nonaka et al. | 345/690 |
| 2011/0227968 | A1* | 9/2011 | Shimizu et al. | 345/690 |

FOREIGN PATENT DOCUMENTS

| | | | |
|---|---|---|---|
| WO | 2010010963 | A1 | 1/2010 |
| WO | 2010-064295 | A1 | 6/2010 |
| WO | WO2010064295 | * | 10/2010 |

OTHER PUBLICATIONS

Shiga, et al., "49.2: Reduction of LCTV Backlight Power and Enhancement of Gray Scale Capability by Using an Adaptive Dimming Technique"; SID 03 Digest, pp. 1364-1367, 2003.

Kim, et al., "How to reduce light leakage and clipping in local-dimming liquid-crystal displays", Journal of the SID 17/12 2009, pp. 1051-1057.

Japanese Office Action dated Sep. 11, 2012 from corresponding JP Application No. 2010-200212, 4 pages.

* cited by examiner

IMAGE DISPLAY APPARATUS AND INFORMATION PROCESSING APPARATUS

CROSS-REFERENCE TO RELATED APPLICATIONS

This application is based upon and claims the benefit of priority from Japanese Patent Application No. 2010-200212, filed Sep. 7, 2010; the entire contents of which are incorporated herein by reference.

FIELD

Embodiments described herein relate generally to an image display apparatus and an information processing apparatus.

BACKGROUND

In a conventional liquid crystal display (LCD), luminances of light sources included in the backlight of the LCD are controlled by dividing the screen of the LCD, for the purposes of, for example, increasing the display dynamic range and reducing the consumption of power. For instance, in JP-A 2007-034251 (KOKAI), the emission intensity of each light source of a backlight is calculated so that the overall luminance of the backlight exceeds the luminance indicated by an input video signal.

However, this technique involves low reproducibility of dark portions and high consumption of power when displaying a video image, such as a night scene, in which the luminance range is wide and bright and dark portions coexist.

DETAILED DESCRIPTION

Referring to the accompanying drawings, an image display apparatus and an information processing apparatus according to embodiments will be described in detail. In the embodiments, like reference numbers denote like elements, and duplicate descriptions will be avoided assuming that the like elements perform like operations.

In general, according to one embodiment, an image display apparatus includes a liquid crystal panel, a backlight, a luminance distribution calculation unit, an error calculation unit, and an emission intensity update unit. The backlight includes a plurality of light sources which emit light. The luminance distribution calculation unit calculates a predicted value for an intensity distribution of light entering the liquid crystal panel if each of the light sources is lit with an emission intensity. The error calculation unit obtains a brightness of a display image which is realized if the each of the light sources is lit with the emission intensity, and the error calculation unit calculates an error between the obtained brightness and an ideal brightness of the display image corresponding to the input video signal. The emission intensity update unit updates the emission intensity of the each of the light sources to reduce the error.

First Embodiment

<Image Display Apparatus>

Figure 1:
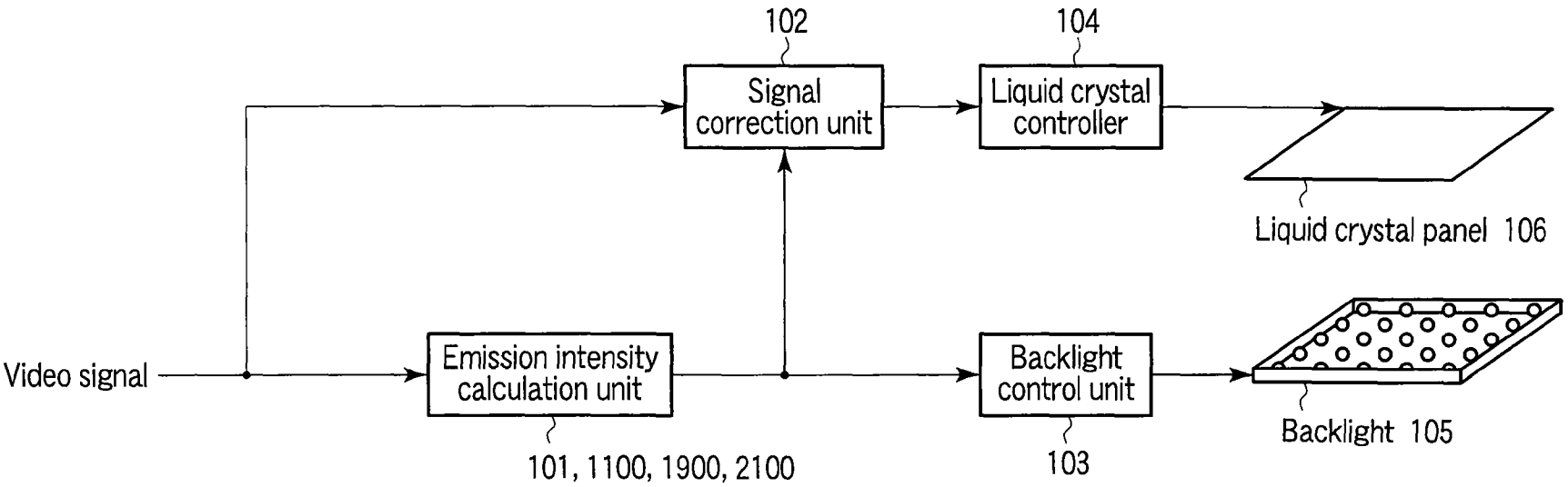
FIG. 1 is an exemplary block diagram illustrating an image display apparatus according to a first embodiment.

Referring first to FIG. 1, an image display apparatus according to a first embodiment will be described. The image display apparatus comprises an emission intensity calculation unit 101, a signal correction unit 102, a backlight controller 103, a liquid crystal controller 104, a backlight 105 and a liquid crystal panel 106 with a plurality of pixels arranged in a matrix.

The emission intensity calculation unit 101 calculates the emission intensity of the backlight suitable for display, based on a one-frame video signal. The emission intensity calculation unit 101 is a type of information processing unit.

The signal correction unit 102 corrects the luminance (light transmittance) of each pixel indicated by the video signal, based on the calculated emission intensity of the backlight 105, and outputs the corrected video signal to the liquid crystal controller 104.

The backlight controller 103 controls lighting (emission) of the backlight 105 in accordance with the emission intensity calculated by the emission intensity calculation unit 101.

The liquid crystal panel controller 104 controls the liquid crystal panel 106 based on the video signal corrected by the signal correction unit 102.

The backlight 105 is lit under the control of the backlight controller 103.

The liquid crystal panel 106 receives light from backlight 105, and varies the amount of light passing therethrough under the control of the liquid crystal controller 104. Namely, the liquid crystal panel 106 modulates the light emitted by the backlight 105, thereby realizing image display.

The structure and operation of each element will be described in detail.

<Backlight>

Figure 2:
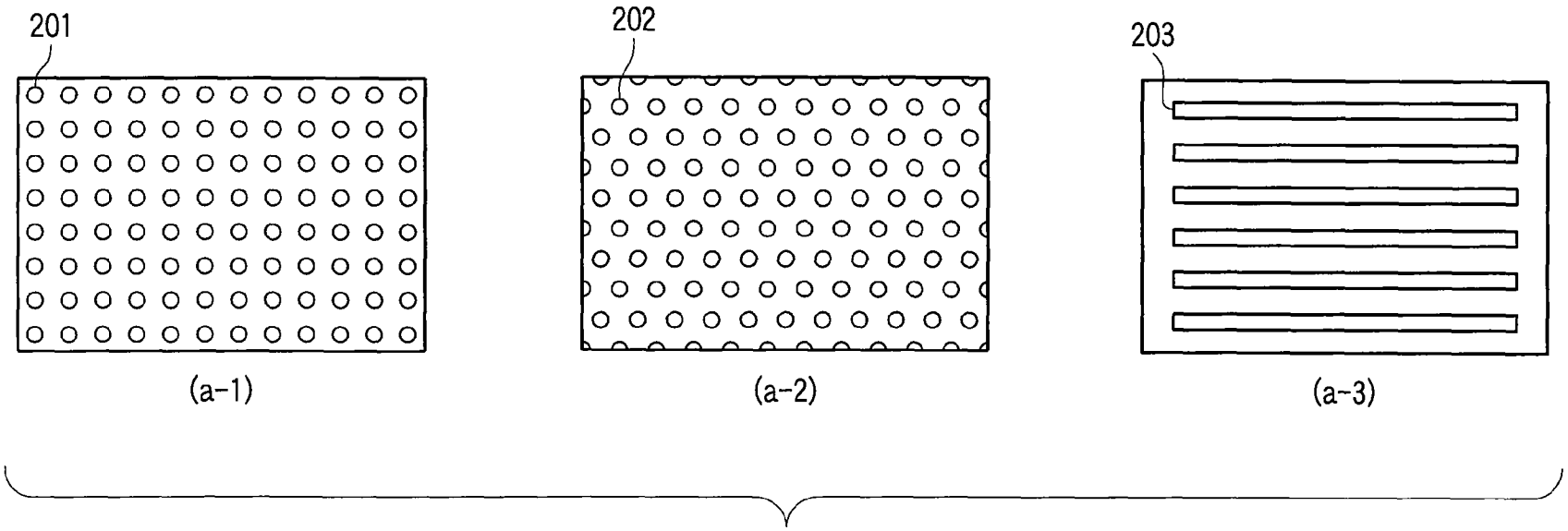
FIG. 2 is an exemplary view illustrating examples of the backlight incorporated in the first embodiment.
Figure 3:
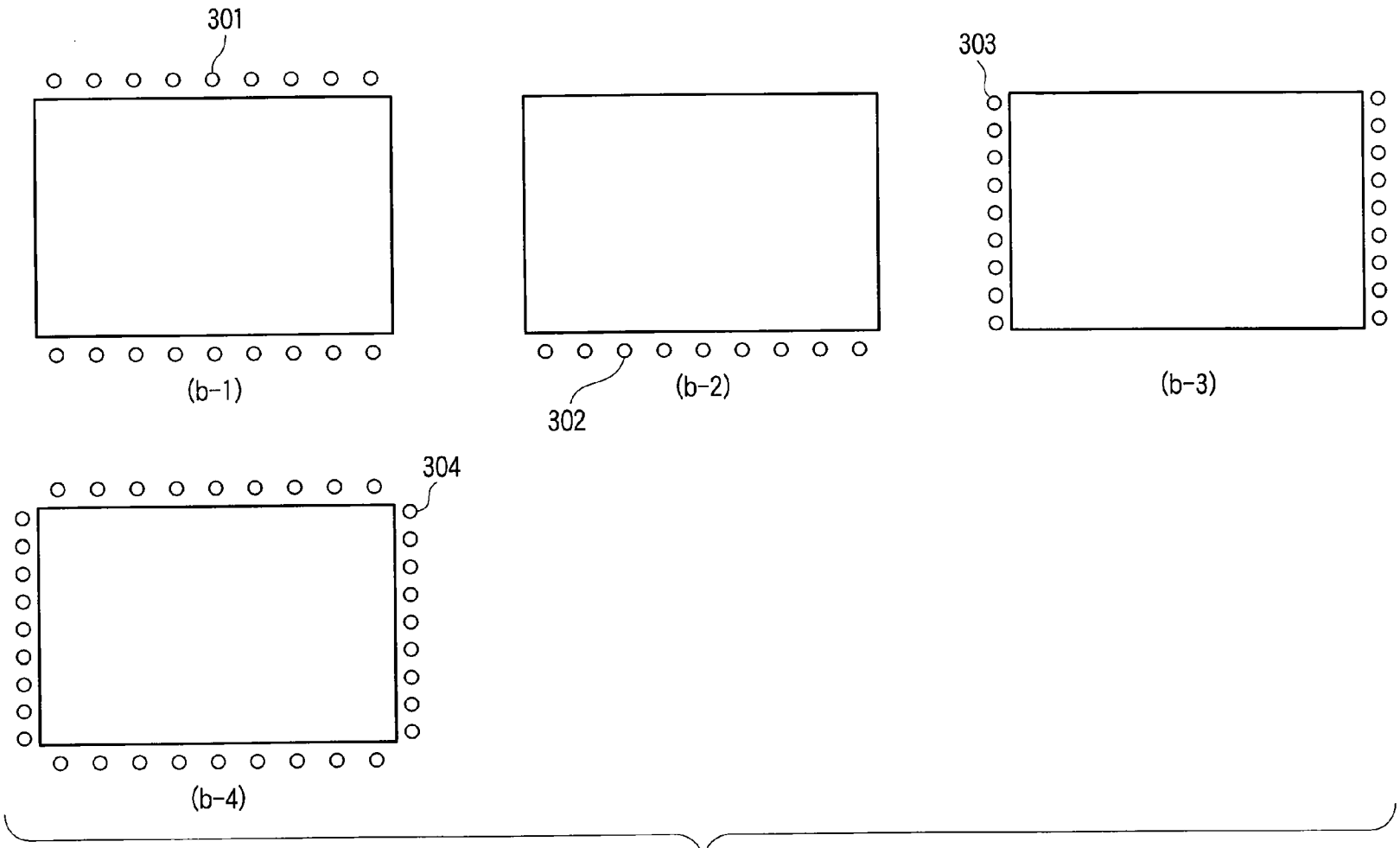
FIG. 3 is an exemplary view illustrating modifications of the backlight incorporated in the first embodiment.

The backlight 105 includes a plurality of light sources. These light sources are lit with respective intensities under the control of the backlight controller 103 to light up the liquid crystal panel 106 from behind. FIGS. 2 and 3 show examples of the backlight 105.

FIG. 2 shows examples of direct-illumination type backlights, in which light sources are arranged on the rear surface of the liquid crystal panel. More specifically, FIG. 2(*a*-1) shows an arrangement example in which dot-shaped light sources are arranged in a lattice on the rear surface of the liquid crystal panel. FIG. 2(*a*-2) shows an arrangement example in which dot-shaped light sources are arranged on the rear surface of the liquid crystal panel in a manner different from that of FIG. 2(*a*-1). FIG. 2(*a*-3) shows an arrangement example in which rectangular light sources are arranged in rows. In contrast, FIG. 3 shows examples of edge-light type backlights, in which light sources are provided along edges (sides) of the liquid crystal panel to guide light therefrom via a light guide plate or reflector (not shown) to the rear surface of the panel to illuminate the same from behind. More specifically, FIG. 3(*b*-1) shows an arrangement example in which dot-shaped light sources are provided along the upper and lower sides (edges) of the liquid crystal panel. FIG. 3(*b*-2) shows an arrangement example in which dot-shaped light sources are provided along the lower side. FIG. 3(*b*-3) shows an arrangement example in which dot-shaped light sources are provided along both vertical sides of the liquid crystal panel. FIG. 3(*b*-4) shows an arrangement example in which dot-shaped light sources are provided along all sides of the liquid crystal panel.

In FIGS. 2 and 3, it is sufficient if the backlight 105 comprises at least one light source. The light sources may be of the direct-illumination type in which they are arranged on the rear surface of the liquid crystal panel, as is shown in FIGS. 2(*a*-1), (*a*-2) and (*a*-3). Alternatively, the light sources may be of the edge-light type in which they are arranged along the side(s) of the liquid crystal panel to guide light therefrom via a light guide plate or reflector (not shown) to the rear surface of the panel to illuminate the same from behind, as is shown in FIGS. 3(*b*-1), (*b*-2) and (*b*-3).

In FIGS. 2 and 3, although each light source seems to be formed of a single light emission element, it may be formed of a single light emission element, or may be formed of a plurality of light emission elements arranged along a plane parallel to the liquid crystal panel.

An LED, a cold cathode tube, a hot cathode tube, etc. are suitable for the light emission element. In particular, the LED is most preferable as the light emission element since the range between its maximum luminance and its minimum luminance is wide, and its emission can be controlled with high dynamic range. The emission intensity (luminance) and the emission timing of each light source can be controlled by the backlight controller.

<Backlight Controller>

The backlight controller 103 controls the intensity of each light source of the backlight 105 based on the corresponding emission intensity calculated by the emission intensity calculation unit 101. The backlight controller 103 can independently control the emission intensity (luminance) and the emission timing of each light source of the backlight 105.

<Liquid Crystal Panel and Liquid Crystal Controller>

Figure 4:
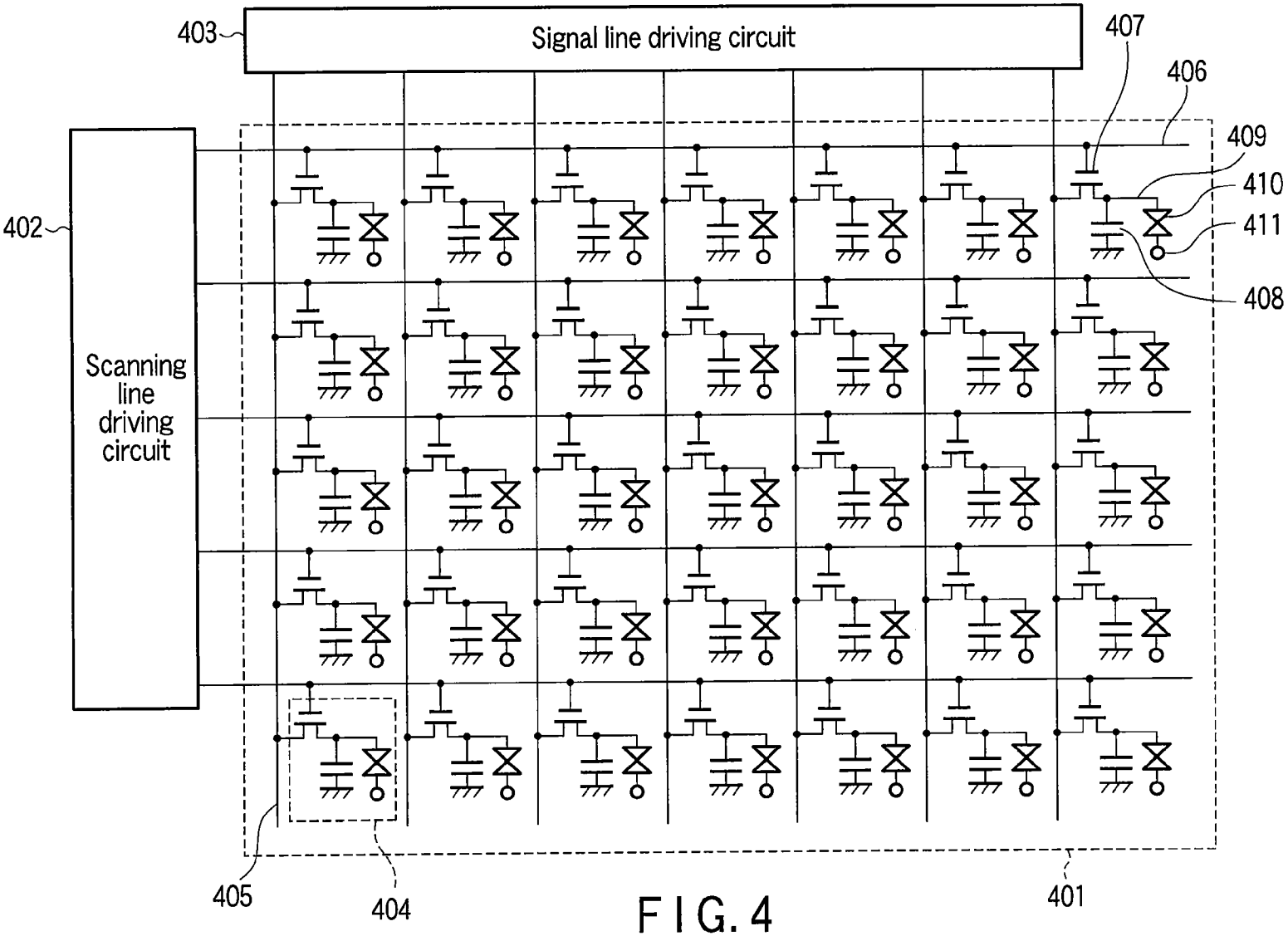
FIG. 4 is an exemplary block diagram illustrating a liquid crystal panel incorporated in the first embodiment.

In the first embodiment, the liquid crystal panel 106 is of an active matrix type. As shown in FIG. 4, in the panel, a plurality of signal lines 405 and a plurality of scanning lines 406 intersecting the signal lines are provided on an array substrate 401 with an insulating film (not shown) interposed therebetween, and pixels 404 are provided at the intersections of those lines. Ends of the signal lines 405 and ends of the scanning lines 406 are connected to a signal line driving circuit 403 and a scanning line driving circuit 402, respectively. Each pixel 404 comprises a switch element 407 formed of a thin-film transistor (TFT), a pixel electrode 409, a liquid crystal layer 410, an auxiliary capacitor 408, and a counter electrode 411. The counter electrode 1911 is connected in common to all pixels.

The switch element 407 is provided for video signal writing, and has its gate connected to one of the scanning line 406, and its source connected to one of the signal lines 405. More specifically, the gates of the switch elements arranged in each row are connected in common to the one scanning line 406, and the sources of the switch elements arranged in each row are connected in common to the one signal line 405. Further, the drain of each switch element 407 is connected to the pixel electrode 409 of the same and also to the auxiliary capacitor 408 of the same arranged electrically parallel to the pixel electrode 409.

The pixel electrode 409 is formed on the array substrate 401, and the counter electrode 411 electrically opposite to the pixel electrode 1909 is formed on a counter substrate (not shown). A predetermined counter voltage is applied to the counter electrode 411 by a counter voltage generation circuit (not shown). The liquid crystal layer 410 is held between the pixel electrode 409 and the counter electrode 411, and the peripheral portions of the array substrate 401 and the counter electrode 411 are sealed by a seal member (not shown). Any liquid crystal material may be used for the liquid crystal layer 410. However, ferroelectric liquid crystal, liquid crystal of an optically compensated bend mode (OCB), etc., are preferable as the liquid crystal material.

The scanning line driving circuit 402 comprises a shift register, a level shifter, a buffer circuit, etc. The scanning line driving circuit 402 outputs a row selection signal to each scanning line based on a vertical start signal and/or a vertical clock signal, which are output as control signals from a display ratio controller (not shown).

The signal line driving circuit 403 comprises an analog switch, a shift register, a sample hold circuit, a video bus, etc., which are not shown. The signal line driving circuit 403 receives a horizontal start signal and a horizontal clock signal output as control signals from the display ratio controller.

The liquid crystal controller 104 controls the liquid crystal panel 106 to adjust its liquid crystal transmittance to that corrected by the signal correction unit 102.

<Emission Intensity Calculation Unit>

Figure 5:
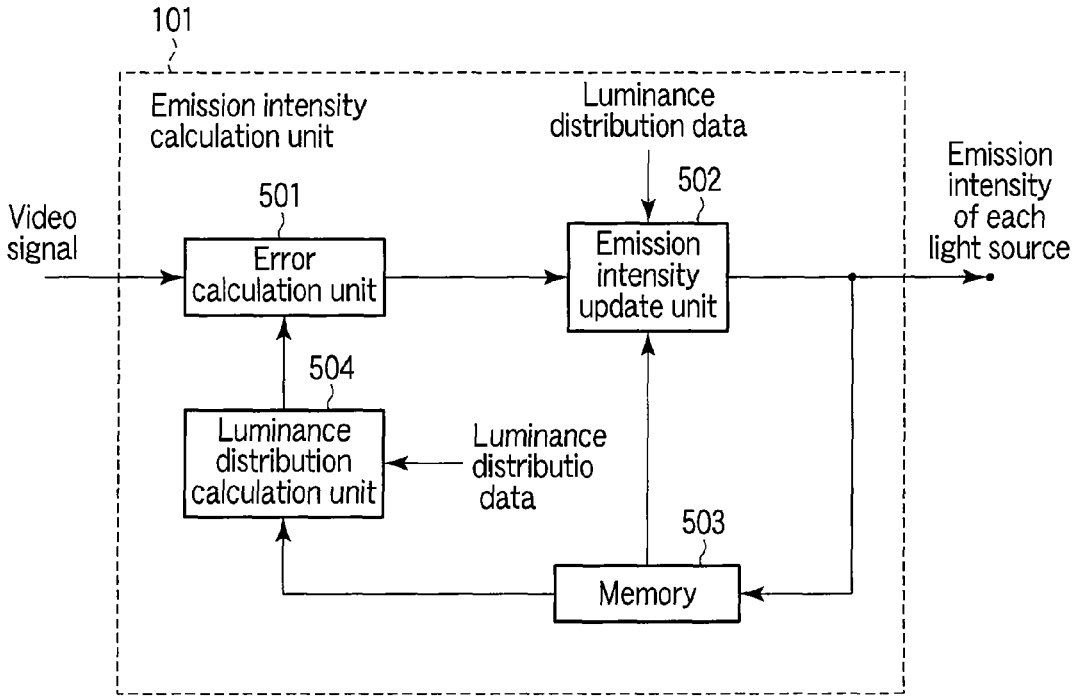
FIG. 5 is an exemplary block diagram illustrating an emission intensity calculation unit incorporated in the first embodiment.

The emission intensity calculation unit 101 calculates the emission intensity of each light source suitable for display, based on a video signal. Referring now to FIG. 5, the emission intensity calculation unit 101 will be described.

The emission intensity calculation unit 101 comprises a luminance distribution calculation unit 504, an error calculation unit 501, an emission intensity update unit 502 and a memory 503. Although the memory 503 stores the emission intensity of each light source, it may store an arbitrary value as the initial intensity value for each light source.

The luminance distribution calculation unit 504 calculates a luminance distribution as a type of intensity distribution of the light entering the liquid crystal panel 106 when each light source of the backlight 105 emits light of the intensity corresponding to that stored in the memory 503.

Based on the luminance distribution calculated by the luminance distribution calculation unit 504 and an input video signal, the error calculation unit 501 calculates an error that will occur at each position on the display screen when display is performed in accordance with the input video signal based on the calculated luminance distribution. The error means the difference at each position between the lightness of an actual display image produced by the image display apparatus and that of an ideal display image corresponding to the input video signal. More specifically, the error is, for example, an increase in luminance in a dark portion of the display image, or a decrease in luminance in a bright portion.

The emission intensity update unit 502 updates the emission intensities stored in the memory 503 for the respective light sources so that each error calculated by the error calculation unit 501 will be reduced.

The emission intensity calculation unit 101 thus iterates updating of the above-mentioned luminance distribution, the error and the emission intensity to thereby calculate the emission intensities of the light sources. The initial value of iteration processing for each light source may be arbitrarily determined. For instance, the minimum or maximum value that can set for each light source may be set as the initial value. Further, for one video image (i.e., one frame), the iteration processing may be executed a predetermined number of times. A detailed description will be given of each element of the emission intensity calculation unit that calculates each error in terms of a numerical value proportional to the luminance, and updates the emission intensity of each light source so that the maximum error occurring on the display screen will be reduced.

Figure 6:
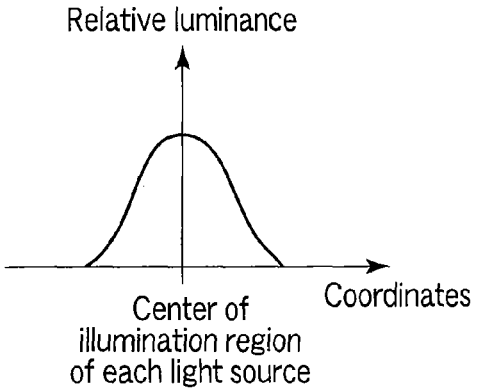
FIG. 6 is an exemplary view illustrating an example of the luminance distribution of each light source of the backlight.

The luminance distribution calculation unit 504 calculates, at each position on the display screen, a predicted value for the luminance distribution of the light entering the liquid crystal panel 106 when the light sources are lit with the respective emission intensities stored in the memory 503. The light entering the liquid crystal panel 106 when the light sources are lit has an emission distribution corresponding to the actual hardware structure of the light sources of the backlight 105, since the light sources each have an emission distribution corresponding to the hardware structure. The intensity of the light entering the liquid crystal panel 106 will hereinafter be referred to simply as the luminance of the backlight 105 or that of the light sources. FIG. 6 shows a luminance distribution example of each light source. If luminance distribution data $l_{p,n}$ obtained by digitizing the luminance distribution is used, the relative luminance at each position (expressed by the corresponding coordinates), obtained when the $n^{th}$ light source is lit with an emission intensity $l_{SET,n}$, is given by $$l_{BL}(\xi_n,\psi_n)=l_{SET,n}\cdot l_{P,n}(\xi_n,\psi_n) \tag{1}$$

where $\xi_n$ and $\psi_n$ are the coordinates of each position relative to the center of the illumination region of the $n^{th}$ light source, and $l_{p,n}$ is the relative luminance of the $n^{th}$ light source at the relative coordinates.

The relative luminance at each pixel position, assumed when each light source of the backlight 105 is lit with the emission intensity $l_{SET,n}$, is calculated as the sum of the values obtained by multiplying the relative luminance of each light source corresponding to said each pixel position by the emission intensity of said each light source. Namely, the luminance distribution $l_{BL}(x, y)$ of the backlight 105 is given by the following equation (2), using the luminance distribution data $l_{P,n}$ corresponding to each light source:

$$l_{BL}(x, y) = \sum_{n=1}^{N} \{l_{SET,n} \cdot l_{P,n}(x - x_{0,n}, y - y_{0,n})\} \tag{2}$$

where x and y are the coordinates of each pixel on the liquid crystal panel 106, $x_{0,n}$ and $y_{0,n}$ are the coordinates of the center of the illumination region of the $n^{th}$ light source on the liquid crystal panel 106, and N is the total number of the light sources. The equation (2) defines that when acquiring the luminance of the backlight 105 at a target pixel, the emission intensities and luminance distributions of all light sources are used. However, the emission intensities and luminance distributions of the light sources that do not significantly influence the luminance of the target pixel can be omitted when the luminance of the target pixel is calculated.

Figure 7:
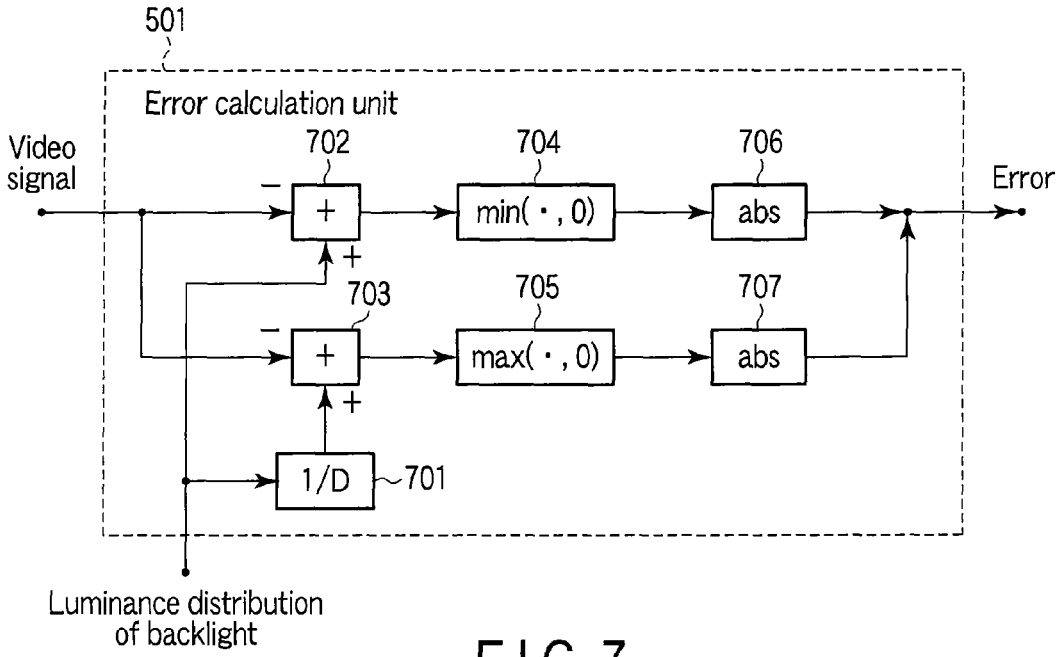
FIG. 7 is an exemplary block diagram illustrating an error calculation unit incorporated in the first embodiment.

Based on the luminance distribution calculated by the luminance distribution calculation unit 504 and an input video signal, the error calculation unit 501 calculates an error that will occur at each position on the display screen when display is performed in accordance with the input video signal under the calculated luminance distribution. More specifically, based on a predicted value for the luminance distribution at each position, and the input video signal, the error calculation unit 501 calculates the lightness of a display video image that will be assumed at each position when the light sources are lit with their respective emission intensities. Further, based on the calculated lightness and an ideal lightness corresponding to the input video signal, the error calculation unit 501 calculates an error at each position. FIG. 7 shows the error calculation unit 501. Assume here that the video signal input to the error calculation unit 501 in the example of FIG. 7 is already transformed by a gamma transformation unit (not shown) into numerical values proportional to the luminance values. The gamma transformation is such a transformation as expressed by the following equation (3). If a video signal is transformed into numerical values proportional to the luminance values, γ in the equation (3) is set to, for example, 2.5.

$$L=(S/255)^{\gamma} \tag{3}$$

where S is the value of the video signal assumed at each position before the gamma transformation, and L is the value assumed after the gamma transformation.

Figure 8:
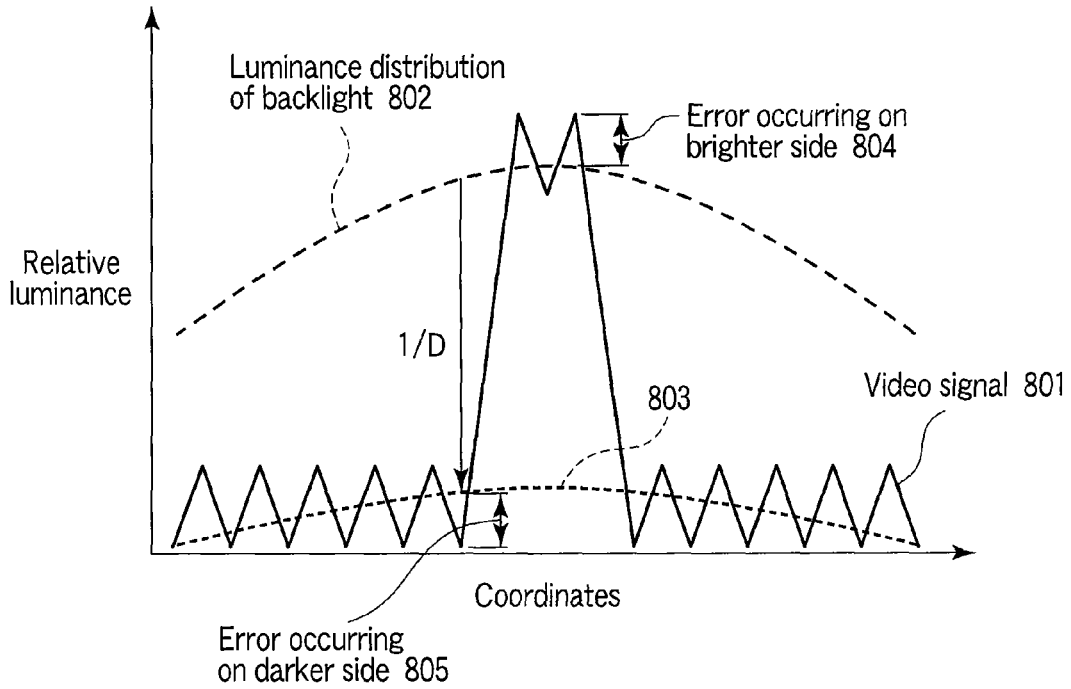
FIG. 8 is an exemplary view illustrating examples of errors between the video signal and the luminance distribution calculated by a luminance distribution calculation unit.

FIG. 8 shows the relationship between the luminance distribution calculated by the luminance distribution calculation unit 504, the input video signal, and the error that will occur at each position on the display screen when display is performed in accordance with the input video signal under the luminance distribution. In FIG. 8, the solid line indicates a video signal 801, and the broken line 802 indicates the luminance distribution of the backlight 105 calculated by the luminance distribution calculation unit 504. Because of the contrast characteristics, the liquid crystal panel 106 has its lower limit concerning the minimum light transmittance that can be realized, and therefore, the luminance, with which display is performed under the luminance of the backlight 105 at each position on the display screen, also has its limit. For instance, if the contrast ratio of the liquid crystal panel 106 is, for example, 1000:1, the upper limit of the luminance range that can be realized on the image display apparatus is equal to that of the backlight 105, while the lower limit is equal to 1/1000 of the luminance of the backlight 105. The dotted line 803 indicates the lower limit of the luminance range that can be realized on the image display apparatus when the contrast ratio of the liquid crystal panel 106 is D:1. Namely, if the luminance distribution 802 of the backlight 105 is similar to that indicated by the broken line, the luminance range that can be realized on the image display apparatus falls within the range defined by the broken line 802 and the dotted line 803, and the luminance falling outside this range cannot be realized. Since, thus, video images corresponding to input video signals that indicate luminances falling within the range defined by the broken line 802 and the dotted line 803 can be displayed, and video images corresponding to input video signals that indicate luminance falling outside the range cannot be displayed, a difference will inevitably occur between a video image that is attempted to be displayed, and a video image that can be displayed. The error calculation unit 501 calculates this difference as an error in display that occurs at each position on the display screen under the luminance distribution of the backlight 105 and a video signal.

The error calculation unit 501 comprises adders 702 and 703, a minimum value calculation unit 704, a maximum value calculation unit 705, and absolute value calculation units 706 and 707. More specifically, the error calculation unit 501 calculates, at each pixel position using the calculation units 704 and 706, an error (804) occurring on the brighter side (of a display image) by subtracting the value of a video signal from the value of the luminance distribution of the backlight 105, using the adder 702. Similarly, the error calculation unit 501 calculates, at each pixel position using the calculation units 705 and 707, an error (805) occurring on the darker side (of the display image) by subtracting, using the adder 703, the value of a video signal from the value obtained by multiplying the value of the luminance distribution of the backlight 105 by 1/D. Assume here that if the value of the video signal falls within the range between the value of the luminance distribution and the value obtained by multiplying the value of the luminance distribution by 1/D, it is considered that there is no error in display, and the error is set to 0. Namely, at each pixel position (x, y), the error calculation unit 501 calculates an error $e_U$ that will occur on the brighter side, and an error $e_L$ that will occur on the darker side, as given by the following equations (4):

$$\begin{cases} e_U(x, y) = |\min(l_{BL}(x, y) - l_{in}(x, y), 0)| \\ e_L(x, y) = \left|\max\left(\frac{1}{D} l_{BL}(x, y) - l_{in}(x, y), 0\right)\right| \end{cases} \quad (4)$$

where $l_{BL}$ is the value of the luminance distribution calculated by the luminance distribution calculation unit 504, $I_{in}$ is the corresponding value of the video signal, min(a, b) is an operation for selecting a lower one of the values a and b, and max(a, b) is an operation for selecting a higher one of the values a and b.

Figure 9:
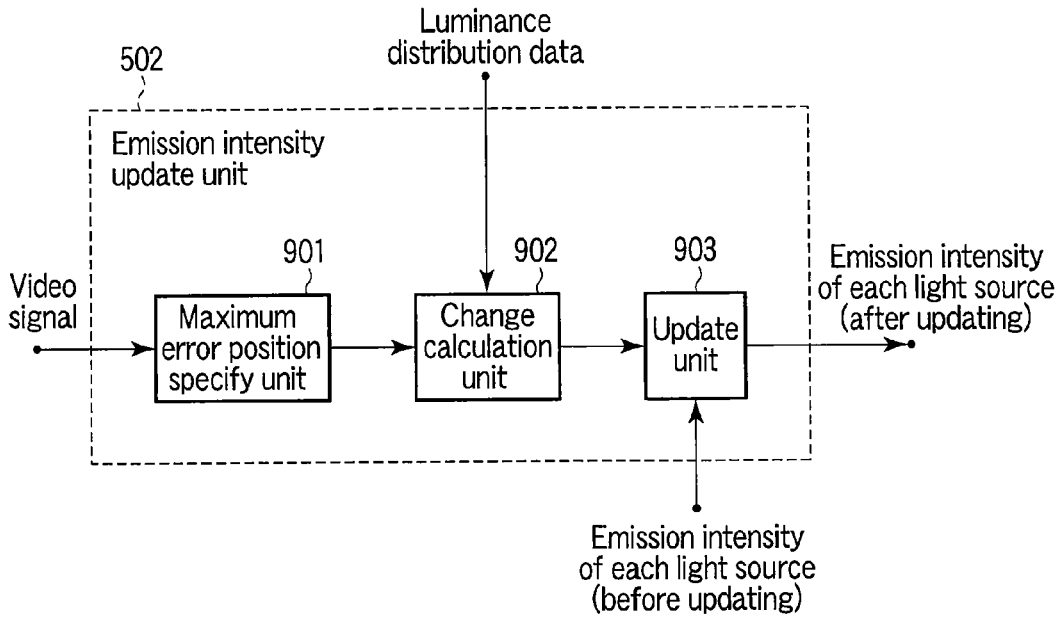
FIG. 9 is an exemplary view illustrating an emission intensity update unit incorporated in the first embodiment.

Based on the error calculated by the error calculation unit 501, and the emission intensity of each light source received from the memory 503, the emission intensity update unit 502 updates the emission intensity of each light source so that the error calculated by the error calculation unit 501 will be reduced, and outputs the updated value. Referring to FIG. 9, the emission intensity update unit 502 will be described.

The emission intensity update unit 502 comprises a maximum error position specify unit 901, a change calculation unit 902 and an update unit 903.

The maximum error position specify unit 901 determines a position (specifically, it determines the coordinates of the position, and whether the position is on the brighter or darker side) at which the maximum error occurs, from the error (including the error on the brighter or darker side) with respect to each position coordinates calculated by the error calculation unit 501.

The change calculation unit 902 calculates a change in the emission intensity of each light source, based on the position, determined by the maximum error position specify unit 901, at which the maximum error occurs, and the luminance distribution data of the light sources.

The update unit 903 updates the emission intensity of each light source based on the change therein calculated by the change calculation unit 902, and outputs the updated value.

Based on the error calculated for each position (each pair of coordinates) by the error calculation unit 501, the maximum error position specify unit 901 specifies the position at which the maximum error occurs, and whether the error is a brighter side error or a darker side error. Assume here that the position coordinates at which the maximum error occurs, calculated by the maximum error position specify unit 901, are set as $x_{max}$ and $y_{max}$.

Based on the position at which the maximum error occurs calculated by the maximum error position specify unit 901, and the luminance distribution data of each light source, the change calculation unit 902 calculates a change in the emission intensity of each light source. For instance, the change calculation unit 902 calculates a change $\Delta l_{SET,n}$ in the emission intensity of the $n^{th}$ light source, using the following equations (5):

$$\Delta l_{SET,n} = l_{P,n}(x_{max} - x_{0,n}, y_{max} - y_{0,n}) \quad (5)$$

(if the maximum error is a brighter side one)

$$\Delta l_{SET,n} = -\frac{1}{D} \cdot l_{P,n}(x_{max} - x_{0,n}, y_{max} - y_{0,n})$$

(if the maximum errror is a darker side one)

In the above equations (5), $x_{max}$ and $y_{max}$ are the coordinates of the position on the liquid crystal panel 106, at which the maximum error is detected by the maximum error position specify unit 901, $x_{0,n}$ and $y_{0,n}$ are the coordinates of the center of the illumination region of the $n^{th}$ light source on the liquid crystal panel 106, and $l_{p,n}$ is the emission intensity data of the $n^{th}$ light source.

The update unit 903 updates the emission intensity of each light source based on the change therein calculated by the change calculation unit 902, and outputs the updated value. Assuming that the emission intensity of the $n^{th}$ light source read from the memory 503 and obtained before the update process is $l_{SET,n}$, and the emission intensity of the $n^{th}$ light source updated by the update unit 903 is $l_{SET,n}'$, the update process is executed by the update unit 903 as shown in the following equation (6):

$$l_{SET,n}' = l_{SET,n} + \tau \cdot \Delta l_{SET,n} \quad (6)$$

where $\Delta l_{SET,n}$ is a change in the emission intensity of the $n^{th}$ light source calculated by the change calculation unit 902, $\tau$ is a preset parameter for update amount adjustment. It is desirable that $\tau$ is set to a positive value.

Alternatively, the update process of the update unit 903 may be executed by normalizing the change in the emission intensity of each light source by the square root of the sum of the squares of the changes in the emission intensities of all light sources, as is given by the following equation (7):

$$l'_{SET,n} = l_{SET,n} + \tau \cdot \frac{\Delta l_{SET,n}}{\sqrt{\sum_{n=1}^{N} (\Delta l^2_{SET,n})}} \tag{7}$$

where N is the total number of light sources. This process enables the change in the emission intensities of all light sources to be set to a constant value whenever one update process is performed.

Yet alternatively, the update process of the update unit 903 may be executed by normalizing the change in the emission intensity of each light source by the sum of the squares of the changes in the emission intensities of all light sources, as is given by the following equation (8):

$$l'_{SET,n} = l_{SET,n} + \tau \cdot \frac{\Delta l_{SET,n}}{\sum_{n=1}^{N} (\Delta l^2_{SET,n})} \tag{8}$$

where N is the total number of light sources. This process enables the expected change in error to be set to a constant value whenever one update process is performed.

In the memory 503, the emission intensity of each light source updated by the emission intensity update unit 502 is written over the preceding emission intensity of said each light source, and is then referred to as preceding emission intensity data in a subsequent iteration process performed by the emission intensity calculation unit 101.

Since the emission intensity update unit 502 is constructed as the above, the emission intensity of each light source stored in the memory 503 is updated so as to reduce the maximum one of the errors calculated by the error calculation unit 501. For instance, if the maximum error occurs on the brighter side at certain position coordinates, this means that the value of the luminance distribution of the backlight 105 at the certain position coordinates is significantly lower than the corresponding value of the input video signal. In this case, the change in the emission intensity of each light source calculated by the change calculation unit 902 assumes a positive value, with the result that the update unit 903 adds a positive value to the emission intensity of each light source, and the emission intensity of each light source is updated to a value corresponding to a higher luminance. Thus, the target value of the luminance distribution of the backlight 105 is adjusted to a higher luminance value to thereby reduce the error occurring on the brighter side. In contrast, if the maximum error occurs on the darker side, the emission intensity update unit 502 updates the emission intensity of each light source to a value corresponding to a lower luminance, whereby the error is reduced. Since the emission intensity update unit 502 is constructed as the above, the emission intensity of each light source stored in the memory 503 is updated so as to reduce the maximum one of the errors calculated by the error calculation unit 501.

<Signal Correction Unit>

Figure 10:
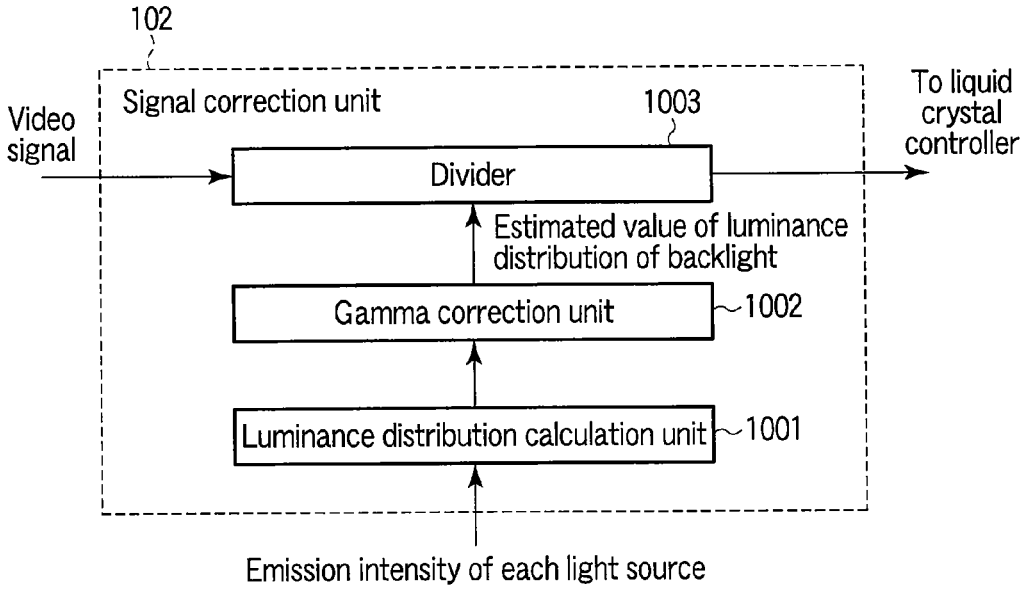
FIG. 10 is an exemplary block diagram illustrating a signal correction unit incorporated in the first embodiment.

The signal correction unit 102 corrects the value of an input video signal corresponding to each pixel on the liquid crystal panel 106, based on the emission intensity of each light source calculated by the emission intensity calculation unit 101, and the input video signal, and outputs the correction result to the liquid crystal controller 104. Referring now to FIG. 10, a specific example of the signal correction unit 102 will be described.

The signal correction unit 102 comprises a luminance distribution calculation unit 1001, a gamma correction unit 1002 and a divider 1003.

The luminance distribution calculation unit 1001 calculates, at each position on the display screen, a predicted value for the luminance distribution of the light entering the liquid crystal panel 106 when the light sources are lit with the respective emission intensities calculated by the emission intensity calculation unit 101. The light entering the liquid crystal panel 106 when the light sources are lit has an emission distribution corresponding to the actual hardware structure of the light sources of the backlight 105, since the light sources each have an emission distribution corresponding to the hardware structure. The intensity of the light entering the liquid crystal panel 106 will hereinafter be referred to simply as the luminance of the backlight 105 or that of the light sources. FIG. 6 shows a luminance distribution example of each light source. If luminance distribution data $l_{p,n}$ obtained by digitizing the luminance distribution is used, the relative luminance at each position (expressed by the corresponding coordinates), obtained when the $n^{th}$ light source is lit with an emission intensity $l_{SET,n}$, is given by $$l_{BL}(\xi_n,\psi_n)=l_{SET,n}\cdot l_{P,n}(\xi_n,\psi_n) \tag{9}$$

where $\xi_n$ and $\psi_n$ are the coordinates of each position relative to the center of the illumination region of the $n^{th}$ light source, and $l_{p,n}$ is the relative luminance of the $n^{th}$ light source at the relative coordinates.

The relative luminance at each pixel position, assumed when each light source of the backlight 105 is lit with the emission intensity $l_{SET,n}$, is calculated as the sum of the values obtained by multiplying the relative luminance of each light source corresponding to said each pixel position by the emission intensity of said each light source. Namely, the luminance distribution $l_{BL}(x, y)$ of the backlight 105 is given by the following equation (10), using the luminance distribution data $l_{P,n}$ corresponding to each light source:

$$l_{BL}(x, y) = \sum_{n=1}^{N} \{l_{SET,n} \cdot l_{P,n}(x - x_{0,n}, y - y_{0,n})\} \tag{10}$$

where x and y are the coordinates of each pixel on the liquid crystal panel 106, $x_{0,n}$ and $y_{0,n}$ are the coordinates of the center of the illumination region of the $n^{th}$ light source on the liquid crystal panel 106, and N is the total number of the light sources. The equation (10) defines that when acquiring the luminance of the backlight 105 at a target pixel, the emission intensities and luminance distributions of all light sources are used. However, the emission intensities and luminance distributions of the light sources that do not significantly influence the luminance of the target pixel can be omitted when the luminance of the target pixel is calculated.

The gamma correction unit 1002 executes gamma correction on the predicted value calculated for luminance distribution by the luminance distribution calculation unit 1001, and converts the resultant value into a signal correction coefficient. Supposing that the output signal correction coefficient falls within a range of [0, 1], the gamma correction is executed using, for example, the following equation:

$$S_{BL} l_{BL}^{1/\gamma} \tag{11}$$

where $l_{BL}$ is the predicted value calculated for luminance distribution by the luminance distribution calculation unit 1001, and $S_{BL}$ is the signal correction coefficient. The gamma correction is not limited to this transformation, but may be replaced with a known transformation method, or inverse transformation based on the gamma transformation table of the liquid crystal panel 106, when necessary. These transformations may be directly executed using, for example, a multiplier, or be executed using a lookup table.

The dividing unit 1003 divides the input video signal by the signal correction coefficient calculated by the gamma correction unit 1002, thereby calculating a video signal output to the liquid crystal controller 104. Alternatively, the dividing unit 1003 may hold a lookup table that stores the relationship between values corresponding to inputs and outputs, and may calculate the video signal output to the liquid crystal controller 104 with reference to the lookup table.

As described above, in the first embodiment, the emission intensity calculation unit calculates the luminance distribution of the light entering the liquid crystal panel, the error calculation unit calculates the error corresponding to an increase in the luminance of the darker portion of a display image or a reduction in the luminance of the brighter portion of the display image, and the emission intensity update unit updates the luminance of each light source so as to reduce the error, whereby the reproduction performance of the darker portion can be enhanced, and the luminance of the brighter portion can be appropriately adjusted. As a result, consumption of power can be reduced.

Second Embodiment

An image display apparatus according to a second embodiment differs from the first embodiment in that in the former, an emission intensity calculation unit 1100 as an information processing apparatus estimates the error in terms of a numerical value proportional to the lightness.

The image display apparatus of the second embodiment comprises a backlight, a backlight controller, a liquid crystal panel, a liquid crystal controller, and a signal correction unit, which are similar to those of the first embodiment. Since these elements are similar to those of the first embodiment, no detailed description will be given thereof.

<Emission Intensity Calculation Unit>

Figure 11:
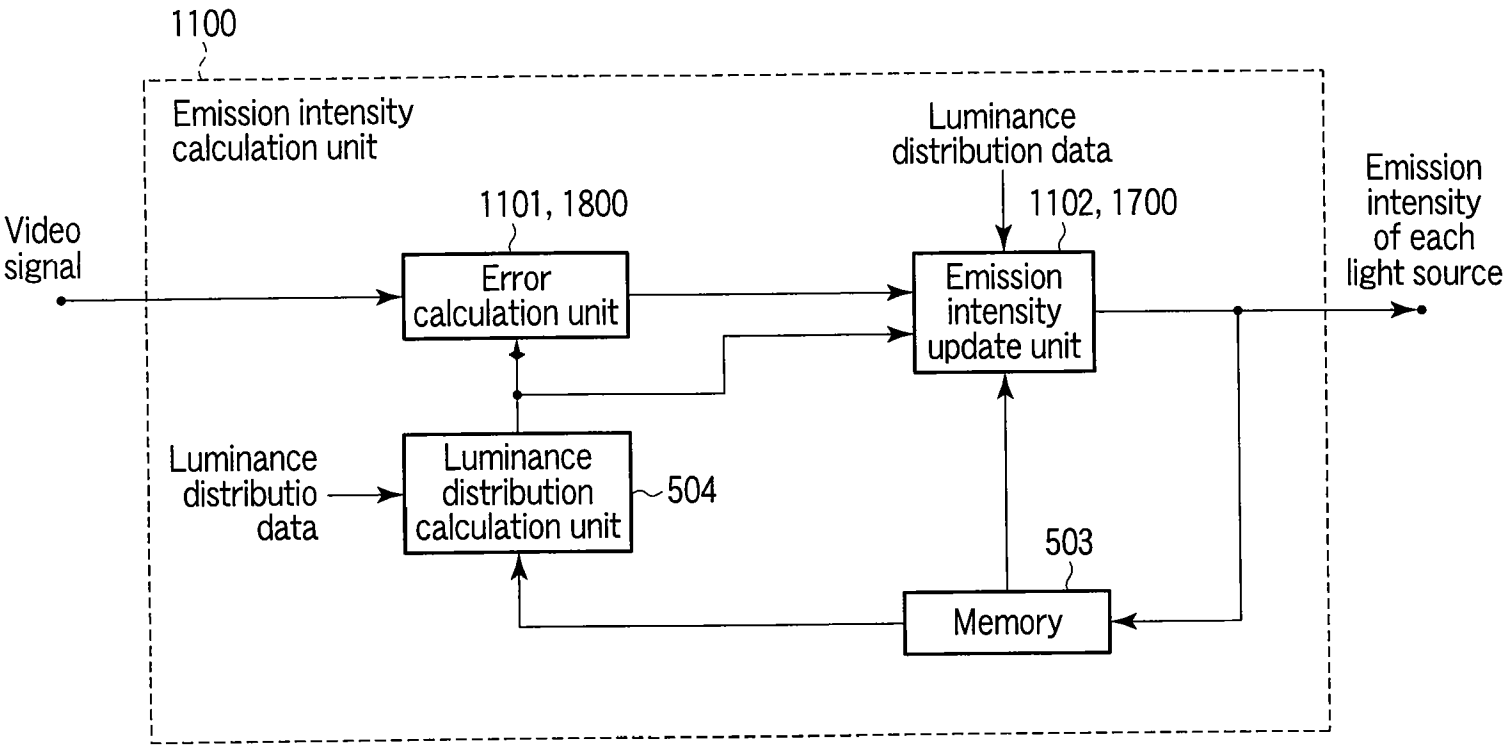
FIG. 11 is an exemplary block diagram illustrating an emission intensity calculation unit incorporated in a second embodiment.

The emission intensity calculation unit 1100 of the second embodiment will be described referring to FIG. 11.

The emission intensity calculation unit 1100 of the second embodiment comprises a luminance distribution calculation unit 504, an error calculation unit 1101, an emission intensity update unit 1102, and a memory 503.

The emission intensity calculation unit 1100 of the second embodiment calculates the emission intensity of each light source suitable for display based on a video signal, as in the emission intensity calculation unit of the first embodiment. More specifically, based on the emission intensity of each light source stored in the memory 503, the luminance distribution calculation unit 504 calculates the luminance distribution of the light entering the liquid crystal panel 106 when each light source of the backlight 105 emits light of the intensity corresponding to that stored in the memory 503.

The error calculation unit 1101 calculates an error that will occur at each position on the display screen when display is performed in accordance with an input video signal based on the luminance distribution calculated by the luminance distribution calculation unit 504 and the input video signal.

The emission intensity update unit 1102 updates the emission intensity of each light source stored in the memory 503, so as to reduce the error calculated by the error calculation unit 1101.

A description will now be given of each element incorporated in the emission intensity calculation unit 1100 that is configured to calculate the error in terms of a numerical value proportional to the lightness, and updates the emission intensity of each light source so as to reduce the maximum error that occurs on the display screen. Since the luminance distribution calculation unit 504 of the second embodiment is similar to the luminance distribution calculation unit of the first embodiment, it will not be described in detail.

Figure 12:
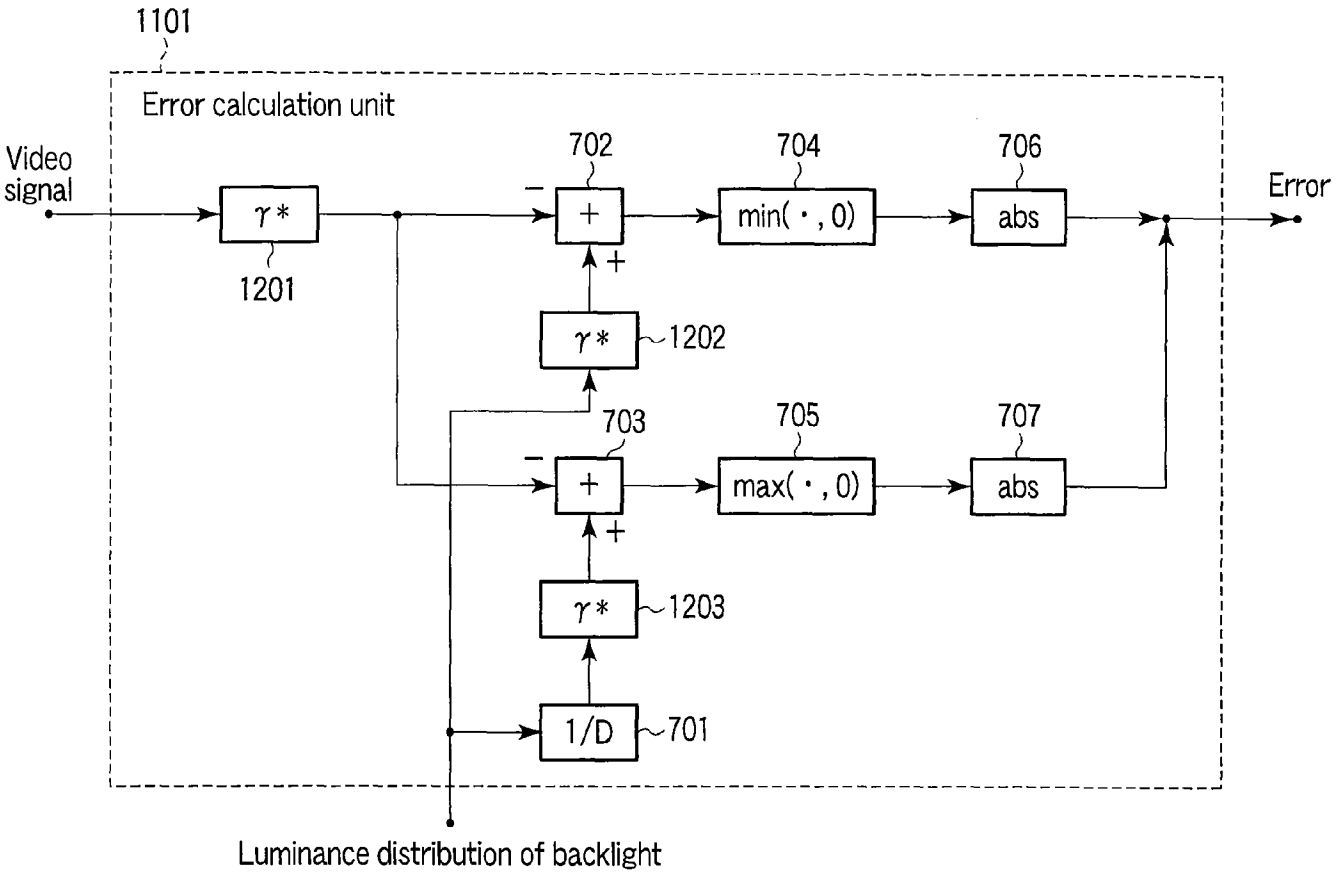
FIG. 12 is an exemplary block diagram illustrating an error calculation unit incorporated in the second embodiment.

Based on the luminance distribution calculated by the luminance distribution calculation unit 504, and an input video signal, the error calculation unit 1101 calculates the error that occurs when display corresponding to the input video signal is executed under the calculated luminance distribution. Referring to FIG. 12, the error calculation unit 1101 will be described. Assume here that the video signal input to the error calculation unit 1101 is beforehand transformed into a numerical value proportional to the luminance value by gamma transformation. The gamma transformation by the gamma transformation unit is such a transformation as given by, for example, the above-mentioned equation (3). When a video signal is transformed into a numerical value proportional to the luminance value, a transformation obtained by setting $\gamma$ to, for example, 2.5 in the equation (3) is executed. In the equation (3), S is the value of the video signal assumed at each position before the gamma transformation, and L is the value assumed after the gamma transformation.

Figure 13:
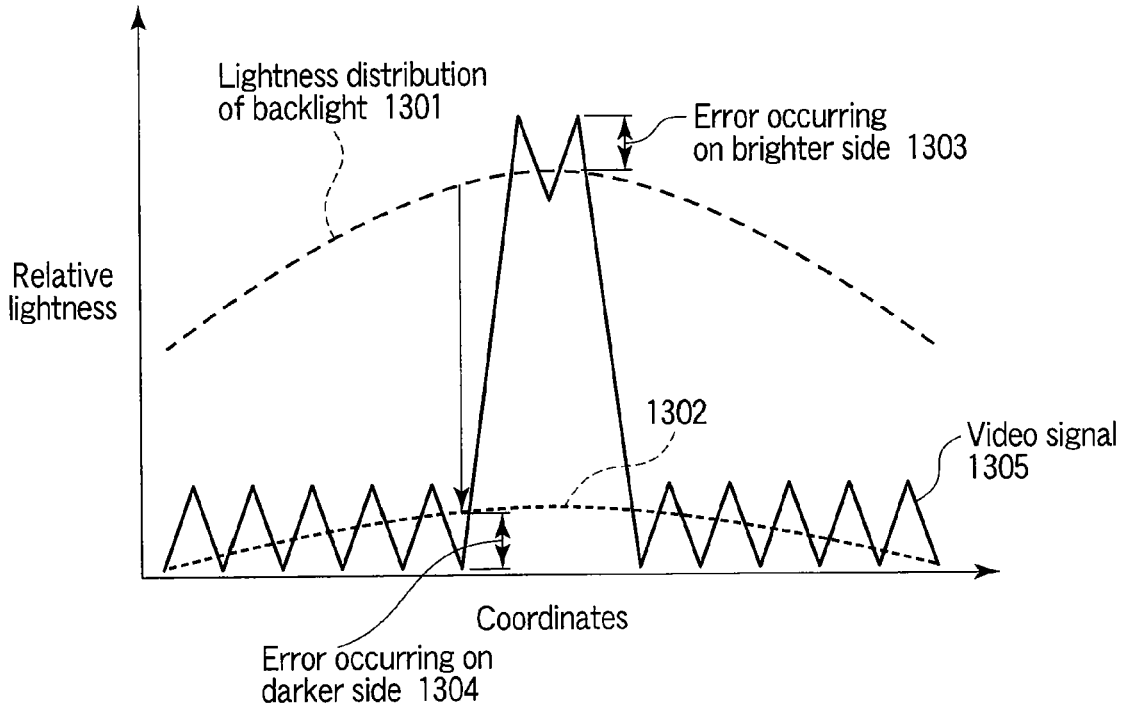
FIG. 13 is an exemplary view illustrating examples of errors between a video signal and the luminance distribution calculated by a luminance distribution calculation unit.

FIG. 13 shows the relationship between the luminance distribution of the backlight 105 calculated by the luminance distribution calculation unit 504 and transformed into a distribution proportional to the lightness, the video signal transformed into a signal proportional to the lightness, and the error that will occur at each position on the display screen when display is performed in accordance with the input video signal under the luminance distribution. The distribution proportional to the lightness, into which the luminance distribution of the backlight 105 is transformed, will hereinafter be referred to simply as a lightness distribution as a type of intensity distribution of the backlight 105. In FIG. 13, the solid line 1305 indicates a signal proportional to the lightness, into which signal the video signal is transformed, and the broken line 1301 indicates the lightness distribution of the backlight 105. Because of the contrast characteristics, the liquid crystal panel 106 has its lower limit concerning the minimum light transmittance that can be realized, and therefore, the lightness, with which display is performed under the lightness of the backlight 105 at each position on the display screen, also has its limit 1302. For instance, if the contrast ratio of the liquid crystal panel 106 is, for example, 1000:1, the upper limit of the lightness range that can be realized on the image display apparatus is equal to the lightness of the backlight 105 (i.e., $(\text{backlight luminance})^{1/3}$). Further, the lower limit is equal to $((1/1000)\times\text{backlight luminance})^{1/3}$. For convenience, the value proportional to the lightness is assumed to be (the value proportional to the backlight luminance)$^{1/3}$. Further, in FIG. 13, the dotted line 1302 indicates the lower limit of the lightness range that can be realized on the image display apparatus. Namely, if the lightness distribution 1301 of the backlight 105 is similar to that indicated by the broken line, the lightness range that can be realized on the image display apparatus falls within the range defined by the broken line 1301 and the dotted line 1302, and the lightness falling outside this range cannot be realized. Since, thus, video images corresponding to input video signals that indicate lightness falling within the range defined by the broken line 1301 and the dotted line 1302 can be displayed, and video images corresponding to input video signals that indicate lightness falling outside the range cannot be displayed, a difference will inevitably occur between a video image that is attempted to be displayed, and a video image that can be displayed. The error calculation unit 1101 calculates this difference as an error in display that occurs at each position on the display screen under the luminance distribution of the backlight 105 and a video signal.

Figure 14:
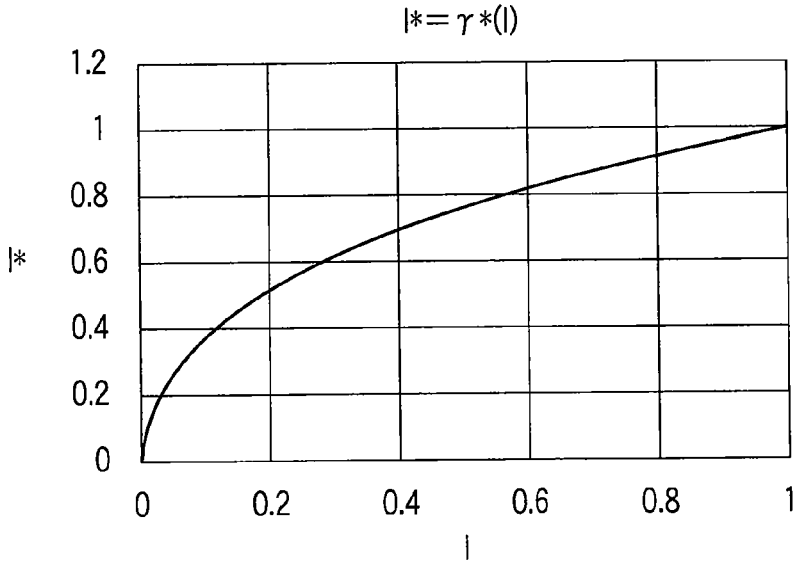
FIG. 14 is an exemplary graph illustrating an example of conversion characteristic from luminance to lightness.

The error calculation unit 1101 comprises luminance-to-lightness transformation units 1201, 1202 and 1203, adders 702 and 703, a minimum value calculation unit 704, a maximum value calculation unit 705, and absolute value calculation units 706 and 707. More specifically, the error calculation unit 1101 calculates, at each pixel position using the calculation units 704 and 706, an error 1303 occurring on the brighter side (of a display image) by subtracting, using the adder 702, the value of a video signal, transformed proportional to the lightness by the luminance-to-lightness transformation unit 1201, from the value of the lightness distribution of the backlight 105 obtained by the luminance-to-lightness transformation unit 1202. Similarly, the error calculation unit 1101 calculates, at each pixel position using the calculation units 705 and 707, an error 1304 occurring on the darker side (of the display image) by subtracting, using the adder 703, the value of a video signal, transformed proportional to the lightness by the luminance-to-lightness transformation unit 1201, from the value (i.e., the value of the backlight luminance distribution×1/D) transformed proportional to the lightness by the luminance-to-lightness transformation unit 1203. Assume here that if the value of the video signal, which is transformed proportional to the lightness, falls within the range between the value of the lightness distribution and the value (i.e., the value of the luminance distribution×1/D) transformed proportional to the lightness, it is considered that there is no error in display, and the error is set to 0. Namely, at each pixel position (x, y), the error calculation unit 1101 calculates an error $e^*_U$ that will occur on the brighter side, and an error $e^*_L$ that will occur on the darker side, as given by the following equations (12):

$$\begin{cases} e^*_U(x, y) = |\min(\gamma^*(l_{BL}(x, y)) - \gamma^*(l_{in}(x, y)), 0)| \\ e^*_L(x, y) = |\max(\gamma^*(l_{BL}(x, y)/D) - \gamma^*(l_{in}(x, y)), 0)| \end{cases} \quad (12)$$

where $l_{BL}$ is the value of the luminance distribution calculated by the luminance distribution calculation unit 504, $I_{in}$ is the corresponding value of the video signal, and $\gamma^*(l)$ is an operation for transforming the value l, which is proportional to the luminance, into a value proportional to the lightness. FIG. 14 shows an example of a transformation characteristic. In FIG. 14, the horizontal axis represents the value proportional to the luminance, and the vertical axis represents the value proportional to the lightness. The error calculation unit 1101 may directly execute the transformation using, for example, a multiplier, or execute the same using a lookup table. Further, in the equations (12), min(a, b) is an operation for selecting a lower one of the values a and b, and max(a, b) is an operation for selecting a higher one of the values a and b.

Figure 15:
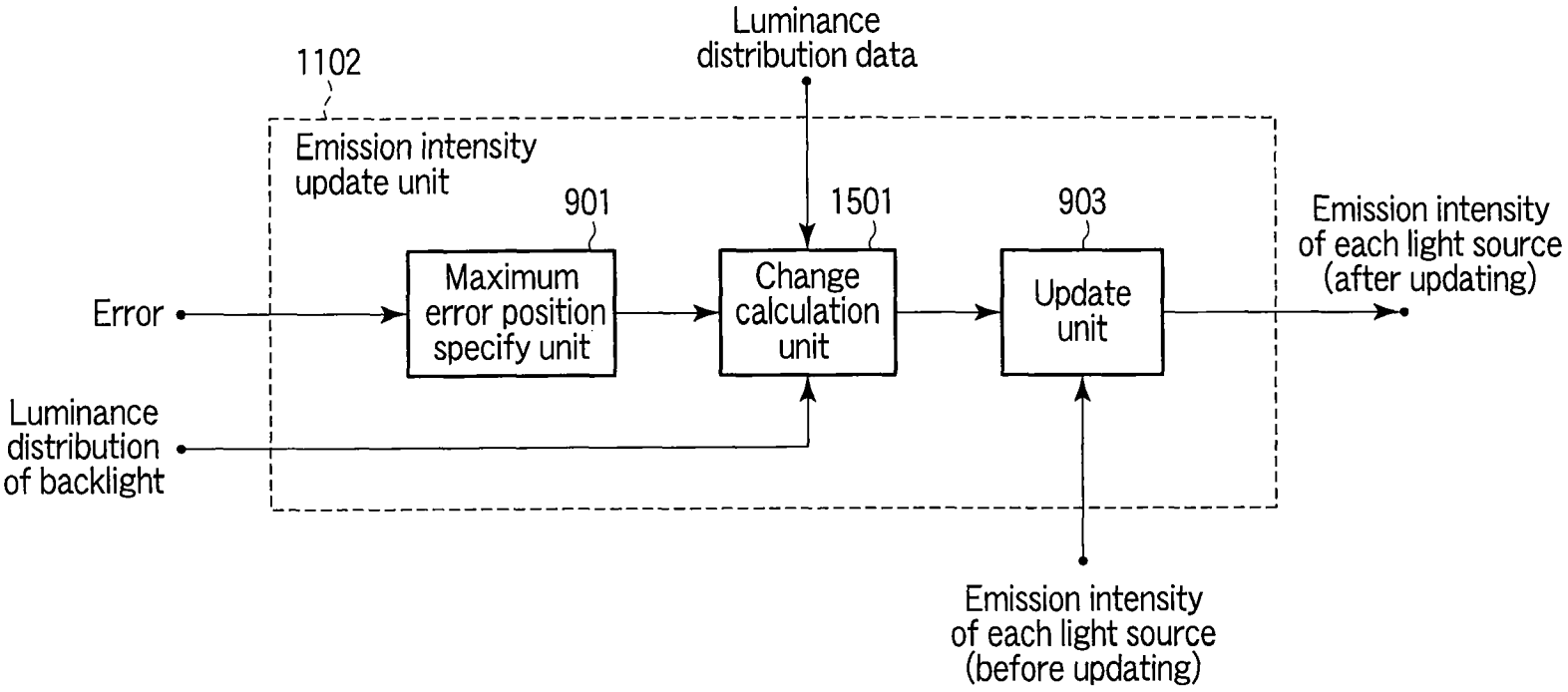
FIG. 15 is an exemplary block diagram illustrating an emission intensity update unit incorporated in the second embodiment.

Based on the error calculated by the error calculation unit 1101, the luminance distribution of the backlight 105 calculated by the luminance distribution calculation unit 504, and the emission intensity of each light source received from the memory 503, the emission intensity update unit 1102 updates the emission intensity of each light source so that the error calculated by the error calculation unit 1101 will be reduced, and outputs the updated value. Referring then to FIG. 15, the emission intensity update unit 1102 will be described.

The emission intensity update unit 1102 comprises a maximum error position specify unit 901, a change calculation unit 1501 and an update unit 903.

The maximum error position specify unit 901 determines a position (specifically, it determines the coordinates of the position, and whether the position is on the brighter or darker side) at which the maximum error occurs, from the error (including the error on the brighter or darker side) with respect to each position coordinates calculated by the error calculation unit 1101.

The change calculation unit 1501 calculates a change in the emission intensity of each light source, based on the position, determined by the maximum error position specify unit 901, at which the maximum error occurs, the luminance distribution of the backlight 105, and the luminance distribution data of the light sources.

The update unit 903 updates the emission intensity of each light source based on the change therein calculated by the change calculation unit 1501, and outputs the updated value.

Based on the error calculated for each position (each pair of coordinates) by the error calculation unit 1101, the maximum error position specify unit 901 specifies the position at which the maximum error occurs, and whether the error is a brighter side error or a darker side error. Assume here that the position coordinates at which the maximum error occurs, calculated by the maximum error position specify unit 901, are set as $x_{max}$ and $y_{max}$.

Based on the position at which the maximum error occurs calculated by the maximum error position specify unit 901, and the luminance distribution data of each light source, the change calculation unit 1501 calculates a change in the emission intensity of each light source. For instance, the change calculation unit 902 calculates a change $\Delta l_{SET,n}$ in the emission intensity of the $n^{th}$ light source, using the following equations (13):

$$\Delta l_{SET,n} = \gamma^{*\prime}(l_{BL}(x_{max} - y_{max})) \cdot l_{P,n}(x_{max} - x_{0,n}, y_{max} - y_{0,n}) \quad (13)$$

(if the maximum error is a brighter side one)

$$\Delta l_{SET,n} = -\frac{1}{D} \cdot \gamma^{*\prime}(l_{BL}(x_{max}, y_{max})/D) \cdot l_{P,n}(x_{max} - x_{0,n}, y_{max} - y_{0,n})$$

(if the maximum errror is a darker side one)

Figure 16:
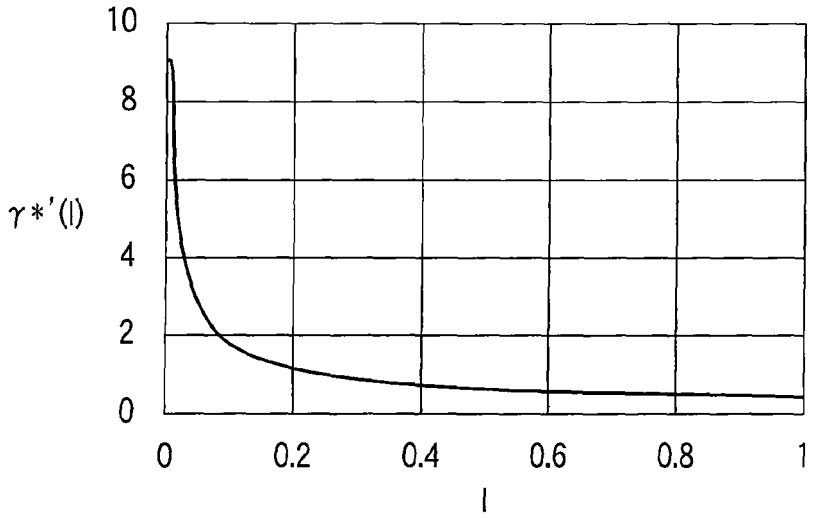
FIG. 16 is an exemplary graph illustrating an example of conversion characteristic of $\gamma^{*\prime}(l)$.

In the above equations (13), $x_{max}$ and $y_{max}$ are the coordinates of the position on the liquid crystal panel 106, at which the maximum error is detected by the maximum error position specify unit 901, $x_{0,n}$ and $y_{0,n}$ are the coordinates of the center of the illumination region of the $n^{th}$ light source on the liquid crystal panel 106, $l_{BL}$ is the value of the luminance distribution of the backlight 105, $l_{p,n}$ is the emission intensity data of the $n^{th}$ light source, and $\gamma^{*\prime}(l)$ is a transformation having such a transformation characteristic as shown in FIG. 16. In FIG. 16, the horizontal axis indicates the value of the input signal to be subjected to this transformation, and the vertical axis indicates the value obtained by the transformation. The change calculation unit 1501 may directly execute the transformation using, for example, a multiplier, or execute using a lookup table.

The update unit 903 of the second embodiment may have the same structure as that of the first embodiment.

In the memory 503, the emission intensity of each light source updated by the emission intensity update unit 1102 is written over the preceding emission intensity of said each light source, and is then referred to as preceding emission intensity data in a subsequent iteration process performed by the emission intensity calculation unit 1100.

Since the emission intensity update unit 1102 is constructed as the above, the emission intensity of each light source stored in the memory 503 is updated so as to reduce the maximum one of the errors calculated by the error calculation unit 1101. For instance, if the maximum error occurs on the brighter side at certain position coordinates, this means that the value of the lightness distribution of the backlight 105 at the certain position coordinates is significantly lower than the corresponding lightness value of the input video signal. In this case, the change in the emission intensity of each light source calculated by the change calculation unit 1501 assumes a positive value, with the result that the update unit 903 adds a positive value to the emission intensity of each light source, and the emission intensity of each light source is updated to a value corresponding to a higher luminance. Thus, the target value of the lightness distribution of the backlight 105 is adjusted to a higher lightness value to thereby reduce the error occurring on the brighter side. In contrast, if the maximum error occurs on the darker side, the emission intensity update unit 1102 updates the emission intensity of each light source to a value corresponding to a lower lightness, whereby the error is reduced. Since the emission intensity update unit 1102 is constructed as the above, the emission intensity of each light source stored in the memory 503 is updated so as to reduce the maximum one of the errors calculated by the error calculation unit 1101.

Further, since the emission intensity calculation unit 1100 is constructed as the above, the emission intensity of each light source held by the memory 503 is updated by the emission intensity update unit 1102 to reduce the error estimated in terms of the value proportional to the lightness. Lightness is a measure substantially proportional to the subjective brightness, and hence if the emission intensity calculation unit 1100 is constructed as the above, the emission intensity of each light source held by the memory 503 is updated by the emission intensity update unit 1102 to uniformly reduce, for the viewers, the errors that will occur on the brighter and darker sides.

<Modification of Emission Intensity Calculation Unit>

The emission intensity calculation unit may be modified as follows:

The emission intensity calculation unit according to the modification calculates the error $e^*_U$ that will occur on a brighter side, and an error $e^*_L$ that will occur on a darker side, using the following equations (12-2):

$$\begin{cases} e^*_U(x, y) = |\min(\gamma^*(l_{BL}(x, y)) - \gamma^*(l_{in}(x, y)), 0)| \\ e^*_L(x, y) = \tau_L \cdot |\max(\gamma^*(l_{BL}(x, y)/D) - \gamma^*(l_{in}(x, y)), 0)| \end{cases} \quad (12\text{-}2)$$

where $l_{BL}$ is the value of the luminance distribution calculated by the luminance distribution calculation unit, $l_{in}$ is the value of an input video signal, $\tau_L$ is a parameter preset for reproduction adjustment, and $\gamma^*(l)$ is an operation for transforming a value l proportional to the luminance into a value proportional to the lightness. FIG. 14 shows an example of a transformation characteristic.

Further, the change calculation unit of the modification calculates a change $\Delta l_{SET,n}$ in the emission intensity of the $n^{th}$ light source, using the following equations (13-2):

$$\Delta l_{SET,n} = \gamma^{*\prime}(l_{BL}(x_{max} - y_{max})) \cdot l_{P,n}(x_{max} - x_{0,n}, y_{max} - y_{0,n}) \quad (13\text{-}2)$$

(if the maximum error is a brighter side one)

$$\Delta l_{SET,n} = -\tau_L \cdot \frac{1}{D} \cdot \gamma^{*\prime}(l_{BL}(x_{max}, y_{max})/D) \cdot l_{P,n}(x_{max} - x_{0,n}, y_{max} - y_{0,n})$$

(if the maximum errror is a darker side one)

where $x_{max}$ and $y_{max}$ are the coordinates of the position on the liquid crystal panel 106, at which the maximum error is detected by the maximum error position specify unit, $x_{0,n}$ and $y_{0,n}$ are the coordinates of the center of the illumination region of the $n^{th}$ light source on the liquid crystal panel 106, $l_{BL}$ is the value of the luminance distribution of the backlight 105, $l_{p,n}$ is the emission intensity data of the $n^{th}$ light source, $\tau_L$ is a parameter preset for reproduction adjustment, and $\gamma^{*\prime}(l)$ is a transformation having such a transformation characteristic as shown in FIG. 16.

By modifying the error calculation unit and the change calculation unit as in this modification, the reproducibility of a display image can be adjusted. Namely, if $\tau_L$ is set to a higher value, the reproducibility of the darker portion is enhanced, while if $\tau_L$ is set to a lower value, the reproducibility of the brighter portion is enhanced.

<Modification of Change Calculation Unit>

The change calculation unit may be modified as will now be described, in accordance with the purpose. The change calculation unit of this modification calculates a change $\Delta l_{SET,n}$ in the emission intensity of the $n^{th}$ light source, using the following equations (13-3):

$$\Delta l_{SET,n} = \gamma^{*\prime}(l_{BL}(x_{max} - y_{max})) \cdot l_{P,n}(x_{max} - x_{0,n}, y_{max} - y_{0,n}) - \tau_{pow} \quad (13\text{-}3)$$

(if the maximum error is a brighter side one)

$$\Delta l_{SET,n} = -\frac{1}{D} \cdot \gamma^{*\prime}(l_{BL}(x_{max}, y_{max})/D) \cdot l_{P,n}(x_{max} - x_{0,n}, y_{max} - y_{0,n}) - \tau_{pow}$$

(if the maximum errror is a darker side one)

where $x_{max}$ and $y_{max}$ are the coordinates of the position on the liquid crystal panel 106, at which the maximum error is detected by the maximum error position specify unit, $x_{0,n}$ and $y_{0,n}$ are the coordinates of the center of the illumination region of the $n^{th}$ light source on the liquid crystal panel 106, $l_{BL}$ is the value of the luminance distribution of the backlight 105, $l_{p,n}$ is the emission intensity data of the $n^{th}$ light source, $\tau_{POW}$ is a parameter preset for adjustment of the power consumption of the backlight 105, and $\gamma^{*\prime}(l)$ is a transformation having such a transformation characteristic as shown in FIG. 16.

By modifying the change calculation unit as in this modification, the power consumption of the backlight 105 can be reduced.

As described above, the second embodiment employs lightness distribution instead of the luminance distribution of the first embodiment, which enables the emission intensity of each light source to be adjusted based on the subjective brightness. As a result, the reproducibility of the darker portion can be further enhanced than in the first embodiment, and that of the brighter portion can also be adjusted more appropriately.

Third Embodiment

An image display apparatus according to a third embodiment differs from the second embodiment in that in the former, the emission intensity calculation unit updates the emission intensity of each light source to reduce the sum of the errors.

The entire structure of the image display apparatus of the third embodiment is similar to that of the second embodiment. Namely, it comprises a backlight, a backlight controller, a liquid crystal panel, a liquid crystal controller and a signal correction unit, which are similar to those of the second embodiment. No detailed description will be given of the similar elements of the third embodiment.

<Emission Intensity Calculation Unit>

The emission intensity calculation unit calculates the emission intensity of each light source suitable for display, based on a video signal, as in the emission intensity calculation unit 1100 of the second embodiment. Since the entire structure of the emission intensity calculation unit is similar to that of the emission intensity calculation unit 1100 of the second embodiment, no detailed description will be given thereof. The emission intensity update unit of the third embodiment updates the emission intensity of each light source stored in the memory 503 so as to reduce the sum of the errors calculated by the error calculation unit. A detailed description will be given of each element of the emission intensity calculation unit that calculates each error in terms of a numerical value proportional to the lightness, and updates the emission intensity of each light source so that the sum of the errors occurring on the display screen will be reduced. Since the luminance distribution calculation unit of the third embodiment is similar to the luminance distribution calculation unit 504 of the first embodiment, no detailed description will be given thereof. Further, since the error calculation unit of the third embodiment is similar to the error calculation unit 1101 of the second embodiment, no detailed description will be given thereof.

Figure 17:
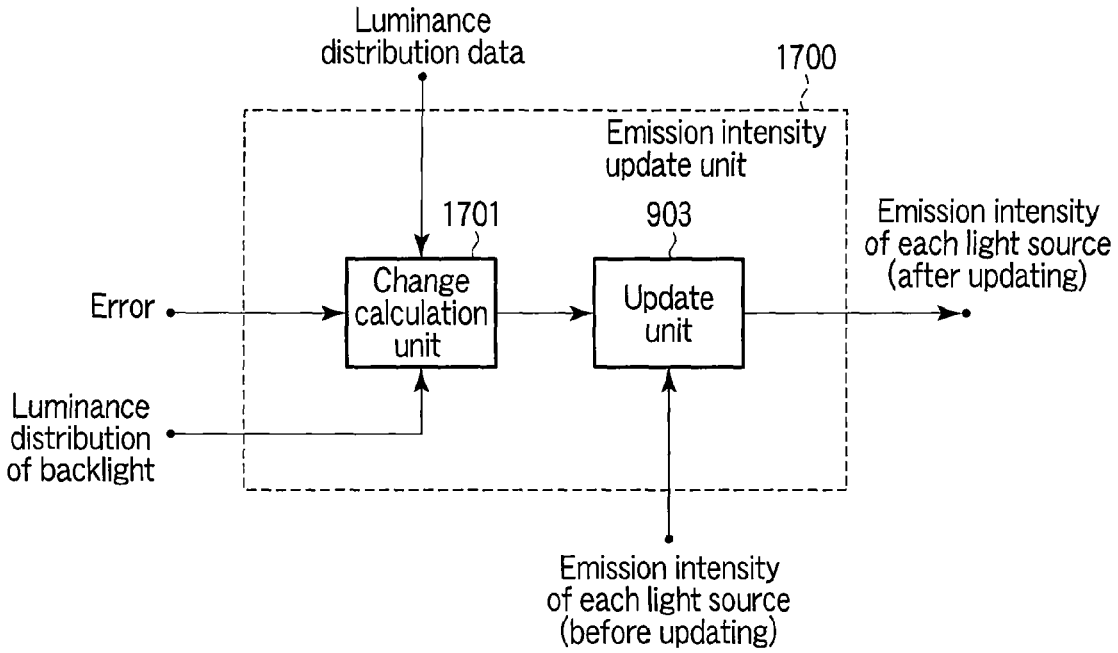
FIG. 17 is an exemplary block diagram illustrating an emission intensity update unit incorporated in a third embodiment.

In the third embodiment, the emission intensity update unit 1700 updates the emission intensity of each light source stored in the memory 503 so as to reduce each error calculated by the error calculation unit 1101, based on said each error calculated by the error calculation unit 1101, the luminance distribution of the backlight 105 calculated by the luminance distribution calculation unit 504, and the emission intensity of each light source read from the memory 503. Referring to FIG. 17, the emission intensity update unit 1700 will be described.

The emission intensity update unit 1700 comprises a change calculation unit 1701 and an update unit 903.

The change calculation unit 1701 calculates a change in the emission intensity of each light source based on the error calculated by the error calculation unit 1101, the luminance distribution of the backlight 105 and the luminance distribution data of each light source.

Based on the change in the emission intensity of each light source calculated by the change calculation unit 1701, the update unit 903 updates the emission intensity of each light source, and outputs the updated value. Since the update unit 903 of the third embodiment is similar to that of the first embodiment, it will not be described in detail.

The change calculation unit 1701 calculates a change $\Delta l_{SET,n}$ in the emission intensity of the $n^{th}$ light source, using, for example, the following equation (14):

$$\Delta l_{SET,n} = K \cdot \sum_{x,y} \left\{ l_{P,n}(x - x_{0,n}, y - y_{0,n}) \cdot \left( e^*_U(x, y)^{K-1} \cdot \gamma^{*\prime}(l_{BL}(x, y)) - \frac{1}{D} \cdot e^*_L(x, y)^{K-1} \cdot \gamma^{*\prime}(l_{BL}(x, y)/D) \right) \right\} \tag{14}$$

where x and y are the coordinates of each pixel, $x_{0,n}$ and $y_{0,n}$ are the coordinates of the center of the illumination region of the $n^{th}$ light source on the liquid crystal panel 106, $e^*_U$ and $e^*_L$ are the errors that will occur on the brighter side and darker side of a display image, respectively, $l_{BL}$ is the value of the luminance distribution of the backlight 105, $l_{p,n}$ is the luminance distribution data of each light source, and K is a natural number preset to adjust the degree to which the influence of the errors is reduced. Further, in the equation (14), $\Sigma_{x,y}\{\ \}$ means the sum of the values { } corresponding to the respective pixels in the display region, and $\gamma^{*\prime}(l)$ is a transformation having such a transformation characteristic as shown in FIG. 16. In FIG. 16, the horizontal axis indicates the value to be input to the transformation, and the vertical axis indicates the value obtained by the transformation. The change calculation unit 1701 may directly execute the transformation using, for example, a multiplier, or execute the same using a lookup table.

In the memory 503, the emission intensity of each light source updated by the emission intensity update unit 1700 is written over the preceding emission intensity of said each light source, and is then referred to as preceding emission intensity data in a subsequent iteration process performed by the emission intensity calculation unit 1100.

Since the emission intensity update unit 1700 is constructed as the above, the emission intensity of each light source stored in the memory 503 is updated so as to reduce the sum of the errors calculated by the error calculation unit 1101.

As described above, the third embodiment can provide the same advantage as the second embodiment by calculating the sum of the errors.

Fourth Embodiment

The image display apparatus of the fourth embodiment differs from the first and second embodiments in that in the former, the emission intensity calculation unit performs calculation using a coordinate space of a lower resolution than the resolution of the input video signal.

Since the image display apparatus of the fourth embodiment is similar to the first and second embodiments in the schematic structure of the entire apparatus, namely, in the structures of the backlight, the backlight controller, the liquid crystal panel, the liquid crystal controller and the signal correction unit, no detailed description will be given thereof.

<Emission Intensity Calculation Unit>

An emission intensity calculation unit 1100 according to the fourth embodiment differs from those of the first and second embodiments in that the former performs calculation using a coordinate space of a lower resolution than the resolution of the input video signal. Since the schematic structure of the entire emission intensity calculation unit is similar to that of the first and second embodiments, it will not be described in detail.

The luminance distribution calculation unit 504 of the fourth embodiment calculates, at each position on the display screen, a predicted value for the luminance distribution of the light entering the liquid crystal panel 106 when the light sources are lit with the respective emission intensities stored in the memory 503. The luminance distribution calculation unit 504 of the fourth embodiment differs from those of the first and second embodiments in that the former performs calculation using a coordinate space of a lower resolution than the resolution of the input video signal. Since the other structure of the luminance distribution calculation unit 504 is similar to that of the first and second embodiments, it will not be described in detail.

Figure 18:
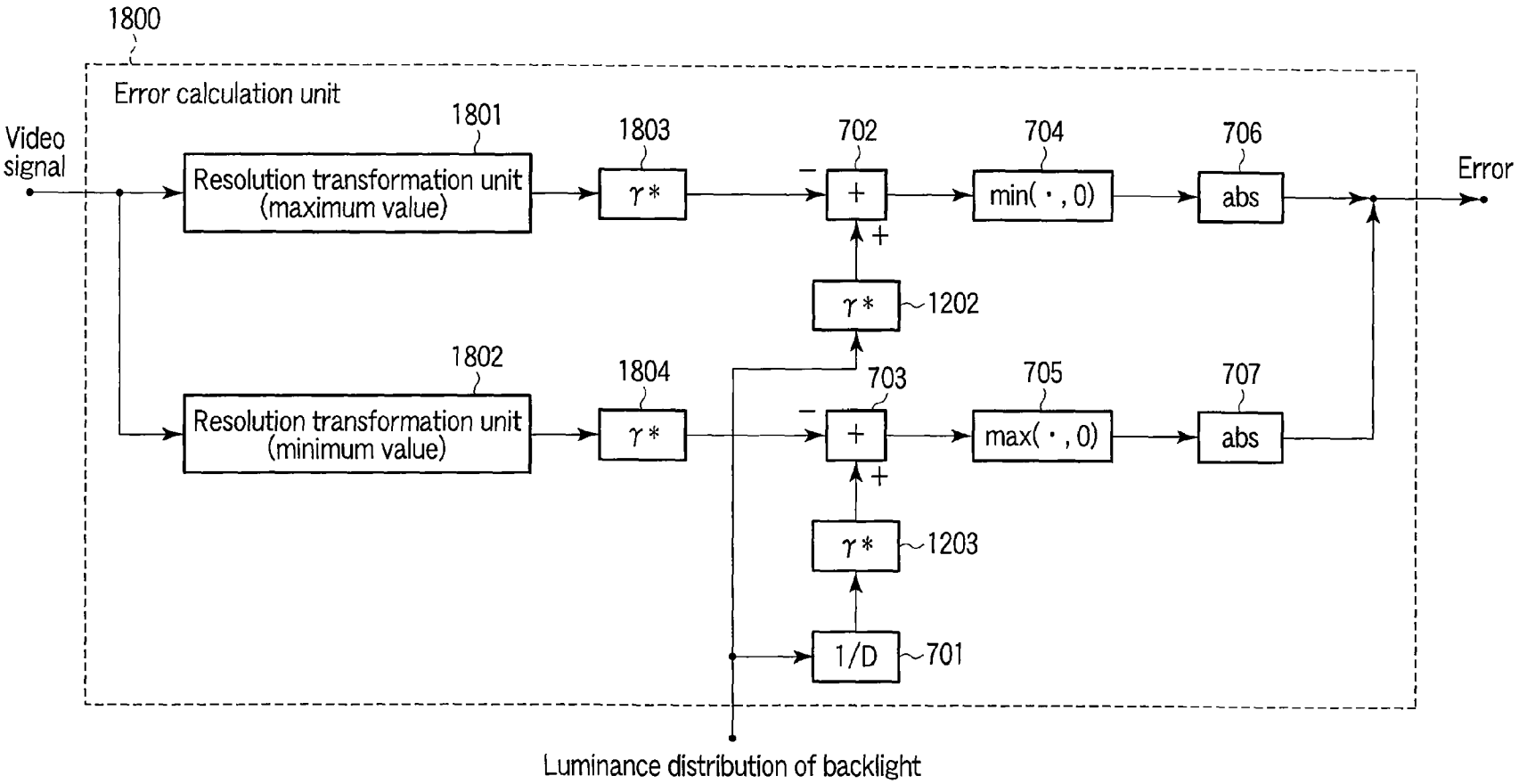
FIG. 18 is an exemplary block diagram illustrating an error calculation unit incorporated in a fourth embodiment.

An error calculation unit 1800 according to the fourth embodiment calculates an error that will occur at each position on the display screen when display is performed in accordance with the input video signal based on the luminance distribution calculated by the luminance intensity calculation unit 504. Referring now to FIG. 18, the error calculation unit 1800 will be described. Assume here that the video signal input to the error calculation unit 1800 is beforehand transformed by a gamma transformation unit (not shown) into a numerical value proportional to the luminance.

The gamma transformation by the gamma transformation unit is given by, for example, the above-mentioned equation (3). When the video signal is transformed into a numerical value proportional to the luminance, transformation with $\gamma$ in the equation (3) set to, for example, 2.5 (y=2.5) is executed on the signal. In the equation (3), S is the value of the video signal assumed before the gamma transformation, and L is the value of the video signal assumed after the gamma transformation.

The error calculation unit 1800 of the fourth embodiment differs from the error calculation unit 1101 in that the former comprises a resolution transformation unit (maximum value) 1801 and a resolution transformation unit (minimum value) 1802. The resolution transformation unit (maximum value) 1801 and the resolution transformation unit (minimum value) 1802 transform the resolution of the video signal already transformed proportional to the lightness. More specifically, the resolution transformation unit (maximum value) 1801 and the resolution transformation unit (minimum value) 1802 transform the resolution of a video signal by re-sampling the video signal in a space sampling of a rougher pitch than the space sampling of the input video signal.

The resolution transformation unit (maximum value) 1801 re-samples the video signal by calculating the maximum value of the video signal near the re-sampling point. Namely, the video signal is re-sampled using the following equation (15):

$$l_{in_max}(X, Y) = \max_{\Delta y=-r_y}^{r_y} \left\{ \max_{\Delta x=-r_x}^{r_x} \{l_{in}(p_X \cdot X + \Delta x,\ p_Y \cdot Y + \Delta y)\} \right\} \tag{15}$$

The resolution transformation unit (minimum value) 1802 re-samples the video signal by calculating the minimum value of the video signal near the re-sampling point. Namely, the video signal is re-sampled using the following equation (16):

$$l_{in_min}(X, Y) = \min_{\Delta y=-r_y}^{r_y} \left\{ \min_{\Delta x=-r_x}^{r_x} \{l_{in}(p_X \cdot X + \Delta x,\ p_Y \cdot Y + \Delta y)\} \right\} \tag{16}$$

In the equations (15) and (16), (x, y) are the coordinates of the sampling point of the input video signal, $l_{in}(x, y)$ are the values, at the sampling point (x, y), of the video signal input to the resolution transformation unit (maximum value) 1801 and the resolution transformation unit (minimum value) 1802, (X, Y) are the coordinates of the re-sampling point of each of the resolution transformation unit (maximum value) 1801 and the resolution transformation unit (minimum value) 1802, px and py are re-sampling pitches that are employed by the resolution transformation unit (maximum value) 1801 and the resolution transformation unit (minimum value) 1802 in accordance with the resolution of the input video signal, and $l_{in_max}(X, Y)$ and $l_{in_min}(X, Y)$ are the values of the input video signal obtained by re-sampling at the coordinates (X, Y). Further, the following equation (20) expresses an operation for calculating the maximum value of $l_{in}$ in the range of $-r_x \le \Delta x \le r_x$. The following equation (21) expresses an operation for calculating the minimum value of $l_{in}$ in the range of $-r_x \le \Delta x \le r_x$.

$$\max_{\Delta x=-r_x}^{r_x} \{l_{in}\} \tag{20}$$

$$\min_{\Delta x=-r_x}^{r_x} \{l_{in}\} \tag{21}$$

The error calculation unit 1800 comprises the aforementioned resolution transformation unit (maximum value) 1801 and resolution transformation unit (minimum value) 1802, luminance-to-lightness transformation units 1803, 1804, 1202 and 1203, adders 702 and 703, a minimum value calculation unit 704, a maximum value calculation unit 705, and absolute value calculation units 706 and 707.

The error calculation unit 1800 calculates, at each pixel position, an error occurring on a brighter side by subtracting, using the adder 702, the value of a video signal from the corresponding value of the lightness distribution of the backlight 105 obtained by the luminance-to-lightness transformation unit 1202. At this time, the video signal is already transformed in resolution by the resolution transformation unit (maximum value) 1801, and already transformed proportional to the lightness by the luminance-to-lightness transformation unit 1803. Similarly, the error calculation unit 1800 calculates, at each pixel position, an error occurring on a darker side by subtracting, using the adder 703, the value of a video signal from the value that is obtained by multiplying the value of the luminance distribution of the backlight 105 by 1/D, and then transforming this value in proportion to the lightness by the luminance-to-lightness transformation unit 1203. At this time, the value of the video signal is already transformed in resolution by the resolution transformation unit (minimum value) 1802, and already transformed proportional to the lightness by the luminance-to-lightness transformation unit 1804. However, if the value of the video signal transformed proportional to the lightness falls between the value of the lightness distribution and the value that is obtained by multiplying the value of the luminance distribution of the backlight 105 by 1/D, and then transforming this value in proportion to the lightness, it is assumed that there is no error on display, and the error is set to 0. Namely, the error calculation unit 1800 calculates, for each pixel position (X, Y), an error $e^*_U$ occurring on a brighter side and an error $e^*_L$ occurring on a darker side, using the following equations (17):

$$\begin{cases} e_U^*(X, Y) = |\min(\gamma^*(l_{BL}(X, Y)) - \gamma^*(l_{in_max}(X, Y)), 0)| \\ e_L^*(X, Y) = |\max(\gamma^*(l_{BL}(X, Y)/D) - \gamma^*(l_{in_min}(X, Y)), 0)| \end{cases} \quad (17)$$

where $l_{BL}$ is the value of the luminance distribution calculated by the luminance distribution calculation unit 504, $l_{in_max}$ is the value of the video signal transformed in resolution by the resolution transformation unit (maximum value) 1801, and $l_{in_min}$ is the value of the video signal transformed in resolution by the resolution transformation unit (minimum value) 1802. Further, $\gamma^*(l)$ is an operation for transforming the value l, which is proportional to the luminance, into a value proportional to the lightness, min(a, b) is an operation for selecting a lower one of the values a and b, and max(a, b) is an operation for selecting a higher one of the values a and b.

The emission intensity update units 1102 and 1700 update the emission intensity of each light source stored in the memory 503 so as to reduce each error calculated by the error calculation unit 1800, based on said each error calculated by the error calculation unit, the luminance distribution of the backlight 105 calculated by the luminance distribution calculation unit, and the emission intensity of each light source read from the memory. The emission intensity update units 1102 and 1700 of the fourth embodiment differ from the first to third embodiments in that these update units perform operations in a coordinate space of a lower resolution than the resolution of the input video signal. Since the structures of these update units are similar to those in the second and third embodiments, they will not be described in detail.

In the fourth embodiment, since the emission intensity calculation unit 110 is constructed as the above, its calculation amount can be reduced to thereby increase its operation speed and reduce its circuit scale.

Fifth Embodiment

An image display apparatus according to a fifth embodiment differs from the first to fourth embodiments in that in the former, the emission intensity calculation unit includes an initial value calculation unit.

Since the image display apparatus of the fifth embodiment is similar to the first to fourth embodiments in the schematic structure of the entire apparatus, namely, in the structures of the backlight, the backlight controller, the liquid crystal panel, the liquid crystal controller and the signal correction unit, no detailed description will be given thereof.

<Emission Intensity Calculation Unit>

Figure 19:
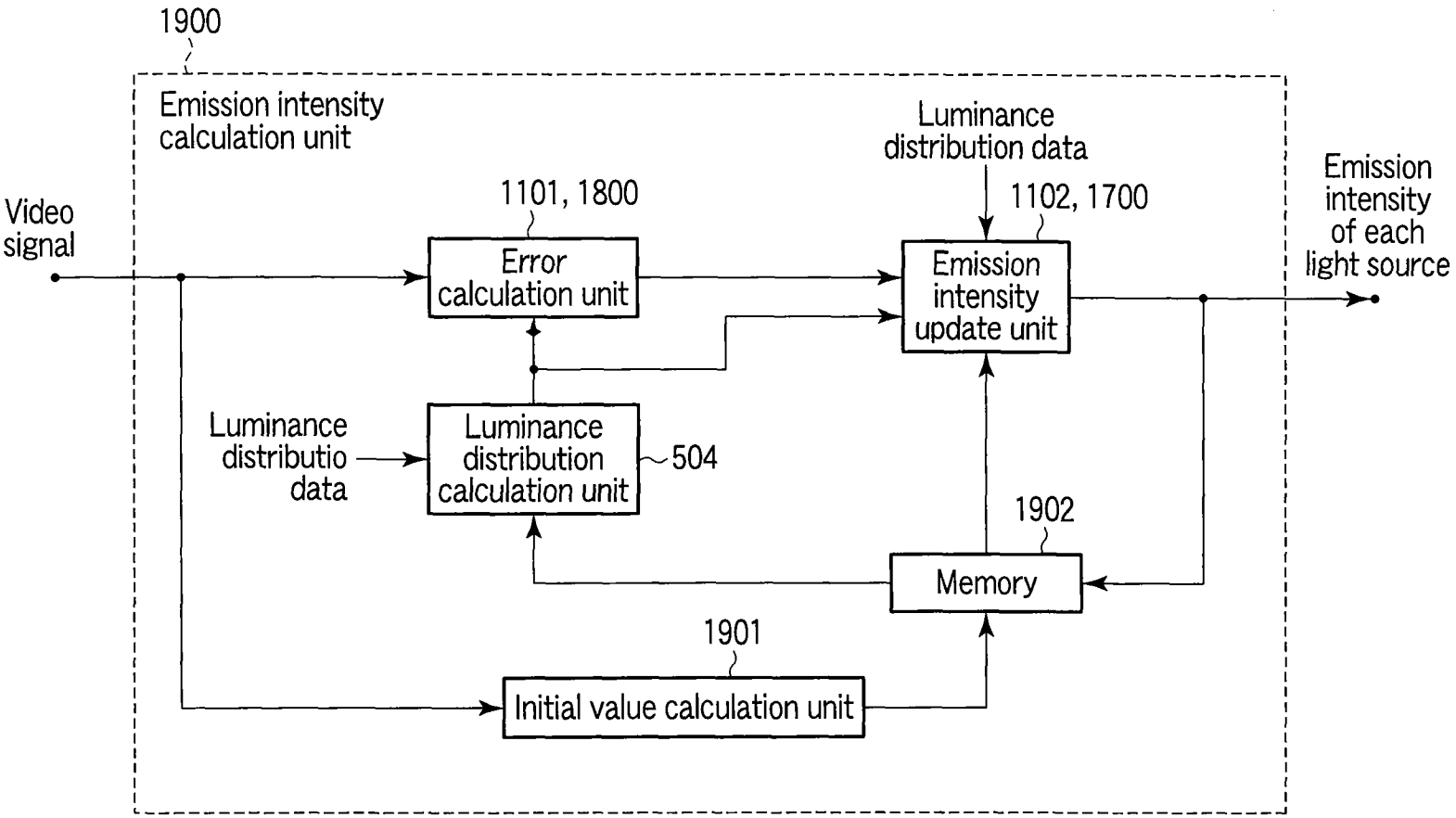
FIG. 19 is an exemplary block diagram illustrating an emission intensity calculation unit incorporated in a fifth embodiment.

An emission intensity calculation unit 1900 incorporated in the fifth embodiment differs from the emission intensity calculation units of the first to fourth embodiments, since it includes an initial value calculation unit 1901. Referring to FIG. 19, the emission intensity calculation unit 1900 of the fifth embodiment will be described. The luminance distribution calculation unit, the error calculation unit and the emission intensity update unit incorporated in the fifth embodiment are similar to those of the first to fourth embodiments, and hence no detailed description will be given thereof.

The initial value calculation unit 1901 calculates, from an input video signal, an emission intensity set as an initial value in the emission intensity calculation unit 1900 for the iteration process concerning a certain frame video signal included in the input video signal. For the certain frame video signal, the emission intensity calculation unit 1900 iterates the luminance distribution calculation, the error calculation and the emission intensity updating, using the luminance distribution calculation unit 504, the error calculation units 1101 and 1800, and the emission intensity update units 1102 and 1700, respectively, thereby calculating the emission intensity of each light source. Hereinafter, the emission intensity of each light source serving as the initial value of the iteration process concerning the certain frame video signal will be referred to simply as the (emission intensity) initial value.

Figure 20:
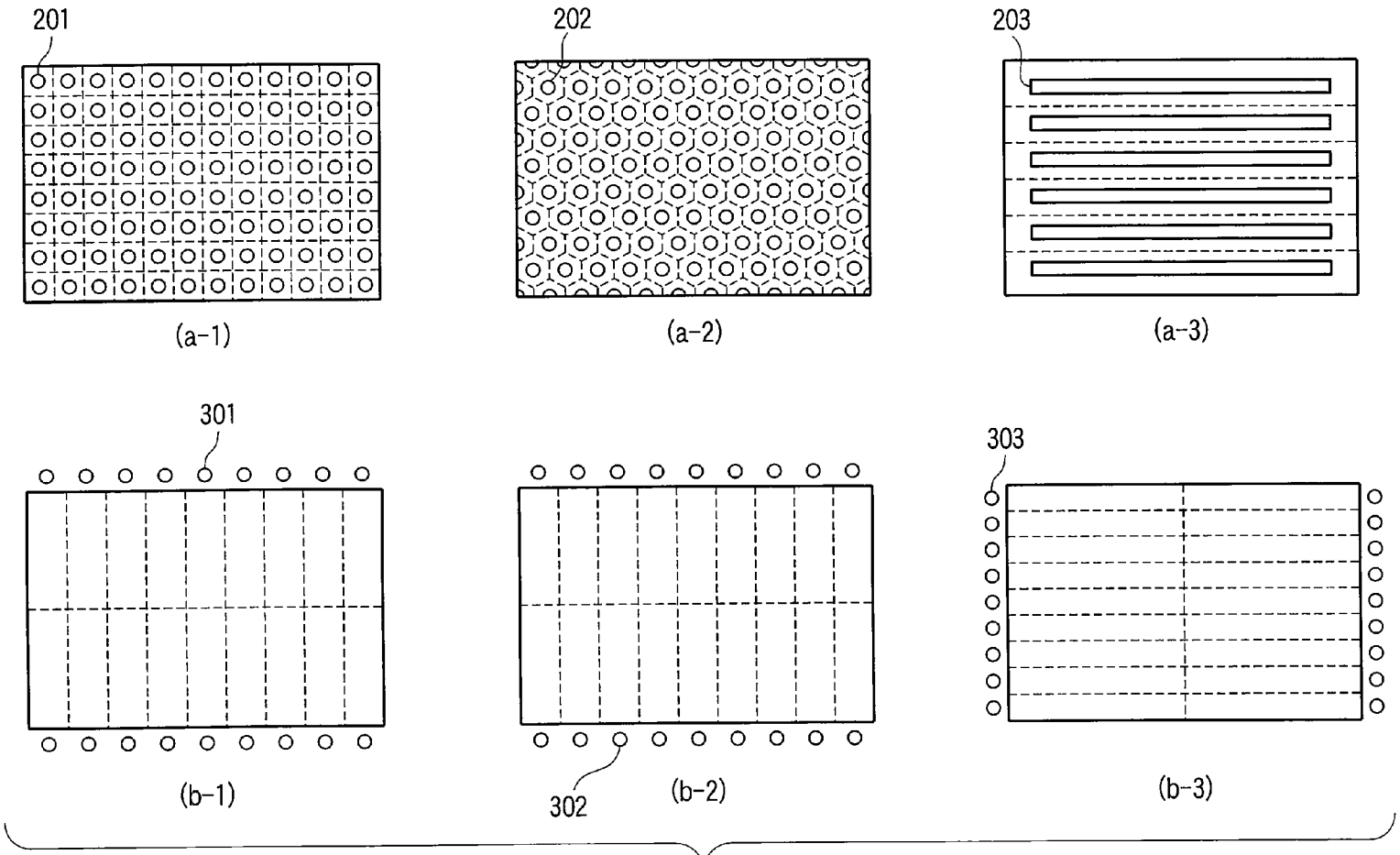
FIG. 20 is an exemplary view illustrating arrangement examples of divisions of a display region corresponding to illumination regions.

The initial value calculation unit 1901 of the fifth embodiment sets the emission intensity of each light source calculated by the initial value calculation unit as the initial value of the emission intensity of said each light source. For instance, the initial value calculation unit 1901 calculates, as the emission intensity of each light source, the maximum luminance of a video signal in the corresponding one of the divisions into which the display region is divided in accordance with the arrangement of the illumination regions of all light sources. FIG. 20 shows an example of a division arrangement of the display region corresponding to the illumination region arrangement of the light sources. In FIG. 20, the regions partitioned by the solid lines and broken lines are the divisions. In the fifth embodiment, the light source closest to each division is set as the light source corresponding to said each division.

In the fifth embodiment, since the emission intensity calculation unit is constructed as the above, the number of iterations of luminance distribution calculation by the luminance distribution calculation unit, the error calculation by the error calculation units, and the emission intensity updating by the emission intensity update units, which are necessary to obtain an appropriate image corresponding to a certain frame video signal, can be reduced.

Sixth Embodiment

An image display apparatus according to a sixth embodiment differs from the first to fifth embodiments in that in the former, an emission intensity calculation unit 2100 includes an initial value calculation unit 2102 and a cut point detection unit 2101.

Since the image display apparatus of the sixth embodiment is similar to the first to fifth embodiments in the schematic structure of the entire apparatus, namely, in the structures of the backlight, the backlight controller, the liquid crystal panel, the liquid crystal controller and the signal correction unit, no detailed description will be given thereof.

<Emission Intensity Calculation Unit>

Figure 21:
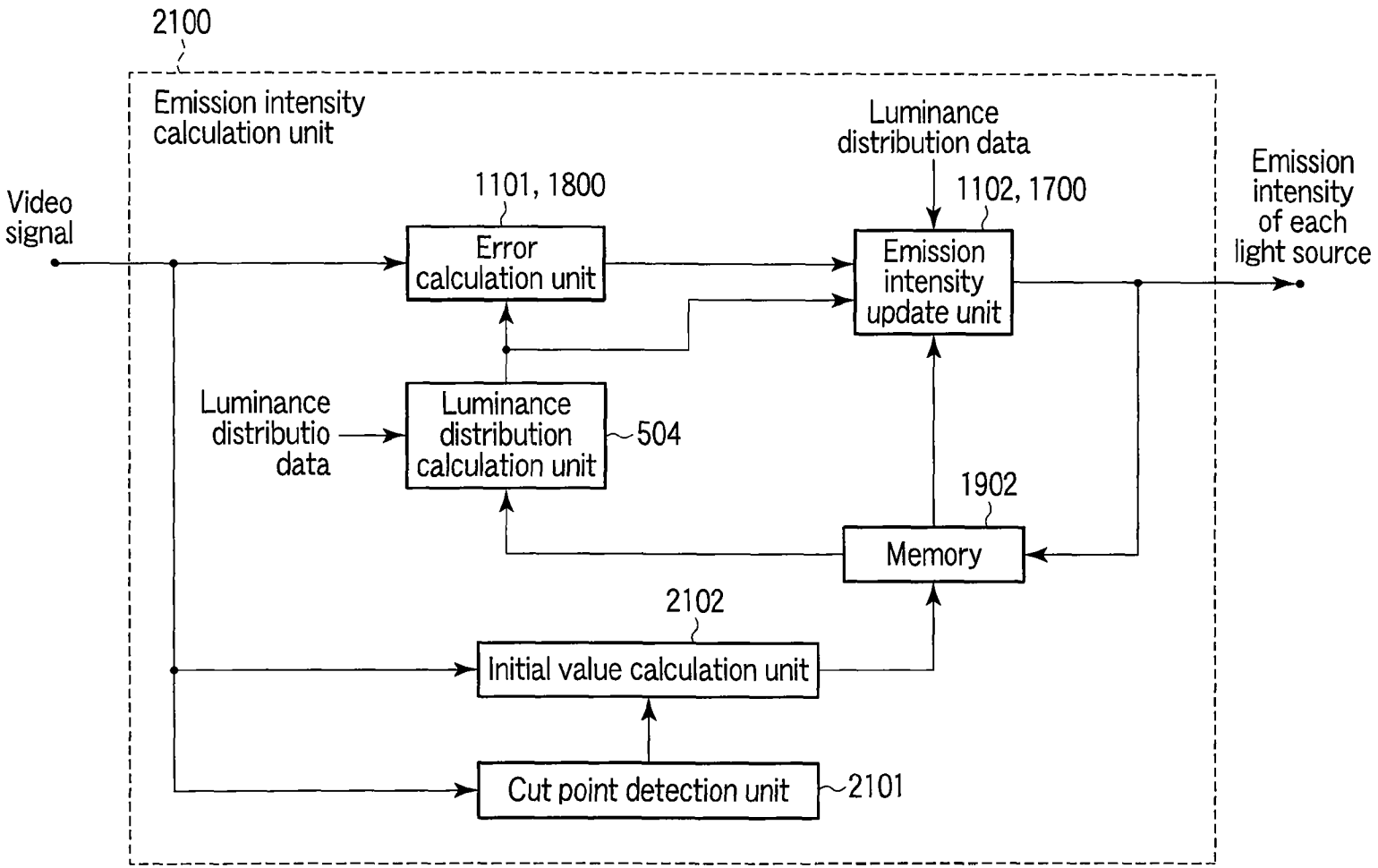
FIG. 21 is an exemplary block diagram illustrating an emission intensity calculation unit incorporated in a sixth embodiment.

Referring to FIG. 21, a description will be given of the emission intensity calculation unit 2100.

The cut point detection unit 2101 detects a cut point in an input video image based on an input video signal. The cut point is where one successive scene is switched to another successive scene.

The initial value calculation unit 2102 calculates, from the video signal, the emission intensity of each light source that serves as the initial value of the emission intensity of said each light source. Upon detection of the cut point at the cut point detection unit 2101, the initial value calculation unit 2102 of the sixth embodiment updates the emission intensity of each light source in a memory to the emission intensity of said each light source calculated by the initial value calculation unit 2102 itself. Namely, when the cut point detection unit 2101 detects the cut point, the emission intensity of each light source calculated by the initial value calculation unit 2102 is used as the initial emission intensity for said each light source. In contrast, when no cut point is detected, the emission intensity of each light source calculated by the emission intensity calculation unit 2100 based on a prior frame video signal is used as the initial emission intensity of said each light source for a posterior frame video signal. The luminance distribution calculation unit, the error calculation units and the emission intensity update units are similar to those of the second to fifth embodiments, and are not described in detail.

The cut point detection unit 2101 detects the cut point of the input video image from the input video signal, using a known cut point detector.

When the cut point is detected, the initial value calculation unit 2102 calculates, from the video signal, the initial value of the emission intensity of each light source.

In a general moving picture, two successive frame images may well be similar to each other. Accordingly, to realize appropriate image display by a small number of iterations of the above-mentioned calculation, it is desirable that the calculation result, corresponding to the prior frame, of the emission intensity of each light source at the emission intensity calculation unit 2100 be set as the initial emission intensity of said each light source corresponding to the posterior frame. Actually, however, two successive frame images with the cut point interposed therebetween may often significantly differ from each other. Therefore, for the frames after the cut point, it is desirable to set, as the initial value of each light source, the emission intensity of said each light source calculated by the initial value calculation unit 2102.

As described above, in the sixth embodiment, since the emission intensity calculation unit 2100 is constructed as the above, the number of iterations of the luminance distribution calculation by the luminance distribution calculation unit, the error calculation by the error calculation units, and the emission intensity updating by the emission intensity update units, which are necessary to obtain an appropriate image corresponding to a certain frame video signal, can be reduced.

Seventh Embodiment

In an image display apparatus according to a seventh embodiment, the backlight may comprise a plurality of backlight components of different emission colors (spectral characteristics). In this case, for each backlight component, the emission intensity calculation unit iterates the luminance distribution calculation by the luminance distribution calculation unit, the error calculation by the error calculation units, and the emission intensity updating by the emission intensity update units, as in the first to sixth embodiments.

For instance, if the backlight 105 comprises backlight components 105 of three colors, i.e., red (R), green (G) and blue (B), the emission intensity calculation unit of the seventh embodiment performs the following processes for each color of a video signal, i.e., calculates the luminance distribution of the light entering the liquid crystal panel 106 when each light source of each backlight component 105 is lit at the corresponding emission intensity stored in a memory, calculates errors on display that occur when display is performed in accordance with an input video signal under the calculated luminance distribution, and updates the emission intensity of each light source stored in the memory so as to reduce the calculated errors.

Further, if the backlight 105 comprises backlight components of colors different from those of the input video signal, each color of the input video signal is converted into a color corresponding to a combination of the emission colors of the backlight components 105, and then the emission intensity calculation unit is constructed as mentioned above for each backlight component.

As described above, since in the seventh embodiment, the emission intensity calculation unit constructed as in the first to sixth embodiments is used for each of the backlight components of different emission colors, the image display apparatus comprising backlight components of different emission colors can provide the same advantage as the image display apparatuses of the first to sixth embodiments.

As described above, the first to seventh embodiments can provide image display apparatuses and information processing apparatuses of low consumption of power capable of displaying the darker portions of images with high reproducibility.

The flow charts of the embodiments illustrate methods and systems according to the embodiments of the invention. It will be understood that each block of the flowchart illustrations, and combinations of blocks in the flowchart illustrations, can be implemented by computer program instructions. These computer program instructions may be loaded onto a computer or other programmable apparatus to produce a machine, such that the instructions which execute on the computer or other programmable apparatus create means for implementing the functions specified in the flowchart block or blocks. These computer program instructions may also be stored in a computer-readable memory that can direct a computer or other programmable apparatus to function in a particular manner, such that the instruction stored in the computer-readable memory produce an article of manufacture including instruction means which implement the function specified in the flowchart block or blocks. The computer program instructions may also be loaded onto a computer or other programmable apparatus to cause a series of operational steps to be performed on the computer or other programmable apparatus to produce a computer programmable apparatus which provides steps for implementing the functions specified in the flowchart block or blocks.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image display apparatus comprising:

a liquid crystal panel;

a backlight including a plurality of light sources configured to light;

a luminance distribution calculation unit configured to calculate a predicted value for an intensity distribution of light entering the liquid crystal panel if each of the light sources is lit with an emission intensity, based on luminance distribution data concerning light entering the liquid crystal panel, and the emission intensity of the each of the light sources;

an error calculation unit configured to obtain, based on the predicted value, a lower limit and an upper limit of a brightness of a display image which is realized if the each of the light sources is lit with the emission intensity, and also configured to calculate a first error and a second error, the first error being between the lower limit and an ideal brightness of the display image corresponding to the input video signal, the second error being between the upper limit and the ideal brightness; and an emission intensity update unit configured to update the emission intensity of the each of the light sources to reduce the first error and the second error, based on the first error, the second error, and the intensity distribution data, and also configured to output the updated emission intensity to the luminance distribution calculation unit.

2. The apparatus according to claim 1, wherein the brightness is a luminance.

3. The apparatus according to claim 2, wherein the emission intensity update unit reduces a maximum difference in the luminance.

4. The apparatus according to claim 1, wherein the brightness is a lightness.

5. The apparatus according to claim 4, wherein the emission intensity update unit reduces a maximum difference in the lightness.

6. The apparatus according to claim 4, wherein the error calculation unit calculates the first and second error for each of pixels in a display region; and the emission intensity update unit reduces a value obtained by summing up errors similar to the first and second errors and calculated for the pixels in the display region.

7. The apparatus according to claim 1, further comprising a transformation unit configured to transform the input video signal indicating the display image into a low resolution video signal indicating an image having a lower resolution than that of the display image, and wherein the error calculation unit calculates the difference using the low resolution video signal as the input video signal.

8. The apparatus according to claim 1, further comprising an initial value calculation unit configured to calculate, as an initial value of the emission intensity of each of the light sources, a maximum luminance of the input video signal in each of divisions of a display region, the divisions corresponding to illumination regions of the light sources.

9. The apparatus according to claim 8, further comprising a detection unit configured to detect a cut point in an input video image from the input video signal, and wherein if the detection unit detects the cut point, the emission intensity of the each of the light sources calculated by the initial value calculation unit is input to the luminance distribution calculation unit.

10. The apparatus according to claim 1, wherein the error calculation unit adds, to a difference, a first adjustment parameter for adjusting the difference in a darker portion of the display image.

11. The apparatus according to claim 1, wherein the emission intensity update unit adds a second adjustment parameter for adjusting consumption of power to a change in the emission intensity of the each of the light sources, the change occurring before and after updating.

12. The apparatus according to claim 1, wherein the backlight includes a plurality of backlight components having different emission colors;

the luminance distribution calculation unit calculates the predicted value for each of the backlight components having different emission colors;

the error calculation unit calculates the error for each of the backlight components having different emission colors; and the emission intensity update unit updates the emission intensity of each of the light sources for each of the backlight components having different emission colors.

13. An information processing apparatus for calculating an emission intensity of each of a plurality of light sources included in a backlight for generating light input to a liquid crystal panel, comprising:

a luminance distribution calculation unit configured to calculate a predicted value for an intensity distribution of light entering the liquid crystal panel if each of the light sources is lit with an emission intensity, based on luminance distribution data concerning light entering the liquid crystal panel, and the emission intensity of the each of the light sources;

an error calculation unit configured to obtain, based on the predicted value, a lower limit and an upper limit of a brightness of a display image which is realized if the each of the light sources is lit with the emission intensity, and also configured to calculate a first error and a second error, the first error being between the obtained brightness and an ideal brightness of the display image corresponding to the input video signal, the second error being between the upper limit and the ideal brightness; and an emission intensity update unit configured to update the emission intensity of the each of the light sources to reduce the first error and the second error, based on the first error, the second error, and the intensity distribution data, and also configured to output the updated emission intensity to the luminance distribution calculation unit.

14. A video image display method comprising:

calculating a predicted value for an intensity distribution of light entering a liquid crystal panel if each of light sources is lit with an emission intensity, based on luminance distribution data concerning light entering the liquid crystal panel, and the emission intensity of the each of the light sources;

obtaining, based on the predicted value, a lower limit and an upper limit a brightness of a display image which is realized if the each of the light sources is lit with the emission intensity, and calculating a first error and a second error, the first error being between the lower limit and an ideal brightness of the display image corresponding to the input video signal, the second error being between the upper limit and the ideal brightness; and updating the emission intensity of the each of the light sources to reduce the first error and the second error, based on the first error, the second error, and the intensity distribution data, and using the updated emission intensity as an input in a subsequent calculation of the predicted value.

15. The apparatus according to claim 9, wherein the cut point being where one successive scene is switched to another successive scene, if no cut point is detected, the emission intensity of each light source calculated by the emission intensity calculation unit is used as the initial emission intensity of said each light source for a posterior frame video signal.

* * * * *